US006612887B1

(12) United States Patent
Kawade

(10) Patent No.: US 6,612,887 B1
(45) Date of Patent: Sep. 2, 2003

(54) METHOD FOR MANUFACTURING ELECTRON SOURCE AND IMAGE-FORMING APPARATUS

(75) Inventor: Hisaaki Kawade, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,073

(22) Filed: Feb. 24, 2000

(30) Foreign Application Priority Data

Feb. 25, 1999 (JP) ..... 11-047881
Feb. 25, 1999 (JP) ..... 11-048648

(51) Int. Cl.[7] ..... H01J 9/02; H01J 9/44
(52) U.S. Cl. ..... 445/6; 445/3; 445/50; 445/51
(58) Field of Search ..... 445/3, 6, 50, 51

(56) References Cited

U.S. PATENT DOCUMENTS 5,066,883 A 11/1991 Yoshioka et al. ..... 313/309
5,591,061 A * 1/1997 Ikeda et al.
5,912,531 A 6/1999 Hasegawa et al. ..... 313/495
6,053,791 A * 4/2000 Fujii et al.
6,336,836 B1 * 1/2002 Suzuki et al.
6,419,539 B1 * 7/2002 Tamura et al.

FOREIGN PATENT DOCUMENTS

EP 726591 A1 * 8/1996 ..... H01J/9/02

OTHER PUBLICATIONS

W.P. Dyke, et al., "Field Emission", Advances in Electronics and Electron Physics, vol. VIII, pp. 89–185 (1956).
C.A. Spindt, et al., "Physical Properties of Thin–Film Field Emission Cathodes with Molybdenum Cones", Journal of Applied Physics, vol. 47, No. 12, pp. 5248–5263 (Dec. 1976).
C.A. Mead, "Operating of Tunnel–Emission Devices", Journal of Applied Physics, vol. 32, No. 4, pp. 646–652 (Apr. 1961).
M.I. Elinson, et al., "The Emission of Hot Electrons and the Field Emission of Electrons From Tin Oxide", Radio Engineering and Electronic Physics, No. 7, pp. 1290–1296 (Jul. 1965).
M. Hartwell, et al., "Strong Electron Emission From Patterned Tin–Indium Oxide Thin Films", International Electron Devices Meeting, pp. 519–521 (1975).
G. Dittmer, "Electrical Conduction and Electron Emission of Discontinuous Thin Films", Thin Solid Films, vol. 9, pp. 317–328 (1972).
H. Araki, et al., Electroforming and Electron Emission of Carbon Thin Films, Journal of the Vacuum Society of Japan, vol. 26, No. 1, pp. 22–29 (Jan. 26, 1983).

* cited by examiner

*Primary Examiner*—Kenneth J. Ramsey
*Assistant Examiner*—Mariceli Santiago
(74) *Attorney, Agent, or Firm*—Fitzpatrick, Cella, Harper & Scinto

(57) ABSTRACT

A method for manufacturing an electron source includes an activation operation for repetitively applying a pulse voltage to a plurality of electron-emitting devices in an atmosphere containing an organic material to form a film containing carbon from the organic material existing in the atmosphere. An activation operation is divided into a plurality of steps from a first activation step to a final activation step, with the plurality of electron-emitting devices being divided into operation units each comprising a plurality of device groups, each of which includes a plurality of electron-emitting devices. The first activation step of the activation operation is sequentially executed from an arbitrary operation unit wherein, in the first activation step, a pulse voltage is applied to each of the plurality of groups sequentially, and the sequential applying of the voltage is repeated. The first activation step for all of the operation units is terminated, and after that, the plurality of electron-emitting devices are divided into operation units each comprising a plurality of device groups, each of which includes a plurality of electron-emitting devices. A next activation step for all of the operation units is terminated in a manner similar to the first activation step, and such a procedure is repeated until the final activation step.

11 Claims, 20 Drawing Sheets

METHOD FOR MANUFACTURING ELECTRON SOURCE AND IMAGE-FORMING APPARATUS

BACKGROUND OF THE INVENTION

1. Field of the Invention

The present invention relates to a method for manufacturing an electron source using electron-emitting devices and, more particularly, to an activation procedure of the electron source.

2. Related Background Art

Heretofore, there have been self light-emitting type image-forming apparatuses such as plasma display, EL display apparatus and image-forming apparatus using an electron beam. Currently, there is increasing a demand for a large-sized screen and high definition, so that need for the self light-emitting type image-forming apparatus is increasing.

As a self light-emitting type image-forming apparatus using, for example, an electron beam, a thin type image-forming apparatus using electron-emitting devices as an electron source for generating an electron beam in a vacuum envelope constructed by a face plate, a rear plate, and an external frame, for accelerating the electron beam and irradiating the beam onto phosphor to emit light, thereby displaying images has been filed by the same applicant as the present invention (JP-A-7-235255).

Since the structure of the above electron-emitting device is simple and the manufacture is easy and the devices can be arranged in array on a large-sized substrate, the electron source is suitable for a large-sized image-forming apparatus. The same applicant as the present invention has disclosed the fundamental structure and manufacturing process of the electron-emitting device and a method for manufacturing an image-forming apparatus using the electron-emitting devices in JP-A-7-235255.

In addition to the electron-emitting device, there are known electron source such as thermionic source using thermionic cathodes, electron-emitting device of a field emission type (W. P. Dyke & W. W. Dolan, "Field emission", Advance in Electron Physics, 8, 89 (1956) and C. A. Spindt, "Physical properties of thin film field emission cathodes with molybdenum cones" J. Appl. Phys., 47, 5248 (1976)), and metal/insulator/metal type electron-emitting device (C. A. Mead, "The tunnel emission amplifier", J. Appl. Phys., 32, 646 (1961)).

As an example of the electron-emitting device type, there is one disclosed by M. I. Elinson, Recio Eng. Electron Phys., 10, 1290, (1965).

The electron-emitting device utilizes a phenomenon that an electron emission is produced in a small-area thin film formed on a substrate by supplying a current in parallel with the film surface. As electron-emitting devices, electron-emitting devices using an $SnO_2$ thin film according to Elinson mentioned above, devices using an Au thin film (G. Dittmer: "Thin Solid Films", 9, 317 (1972)), devices using an $In_2O_3/SnO_2$ thin film (M. Hartwell and C. G. Fonstad: "IEEE Trans. Ed Conf.", 519 (1975)), and devices using a carbon thin film (Hisashi Araki et al.: "Vacuum", vol.26, No.1, p.22 (1983)) have been reported.

A construction of the above-mentioned device according to M. Hartwell is schematically shown as a typical example of those electron-emitting devices in FIG. 19. FIG. 19 is a schematic diagram showing an example of the surface conduction type electron-emitting device as a related art.

Referring to FIG. 19, reference numeral 1 denotes a substrate; and 4 an electroconductive thin film made of metal oxide by sputtering, being formed in an H-shaped pattern. An electron-emitting region 5 is formed in the thin film by an energization operation called "energization forming" which will be described hereinlater. In FIG. 19, a device electrode interval L is set to 0.5 to 1 mm and a width W' is set to 0.1 mm.

Hitherto, in the electron-emitting device, the electron-emitting region 5 is generally formed by previously performing the energization operation called "energization forming" to the electroconductive thin film 4 before the electron emission. In other words, in the energization forming, energization is made by applying a direct current voltage or a voltage that increases at a very slow rate of, for example, 1V/min to both ends of the electroconductive thin film 4 so as to partially destroy or deform the electroconductive thin film, or change in properties of the film, so that the electron-emitting region 5 in an electrically high-resistant state is formed. A fissure is partially formed in the electroconductive thin film 4 by the energization forming. In the electron-emitting device to which the energization forming operation has been performed, the voltage is applied to the electroconductive thin film 4 to supply the current through the device, so that electrons are emitted near the fissure in the electron-emitting region 5.

The present applicant has proposed an image-forming apparatus constructed by combining an electron source in which a large number of the above-mentioned electron-emitting devices are arranged and phosphor which emits visible light due to the electrons emitted from the electron source (U.S. Pat. No. 5,066,883).

The present applicant has proposed that upon manufacturing the above-mentioned electron source and image-forming apparatus, a new process referred to as an activation operation (to be described in detail hereinlater) is performed to the foregoing electron-emitting devices, the activation procedure controls to form a film constituted of graphite, amorphous carbon, or mixture of them, containing carbon as a main component, near the electron-emitting region of the electron-emitting device, so that an emission current from each electron-emitting device can be increased in a vacuum.

The activation procedure is an operation which is performed to the electron-emitting devices after completion of the forming operation and which enables the emission current from the devices to be remarkably increased by repeating the application of a predetermined pulse voltage in an environment at a degree of vacuum of substantially $1\times10^{-4}$ to $1\times10^{-5}$ Torr. FIG. 4 shows an example of a pulse voltage waveform upon activation operation and FIG. 5 shows an example of time change in device current If and emission current Ie running through the electron-emitting devices upon activation operation.

Executing the activation operation results in an increase of the emission current Ie of the electron-emitting devices, so that the performance of the electron source utilizing the devices and image-forming apparatus can be improved.

The above-mentioned activation procedure is utilized to increase the emission current Ie. In the image-forming apparatus having the electron source comprising a plurality of electron-emitting devices in a vacuum container, however, realization of a large size is desired in recent years, the number of electron-emitting devices used in the electron source is extremely increased in association with the enlargement, and the activation operation requires a long time in association with the increase, so that an increase of manufacturing costs becomes a problem.

The following method has been considered in order to solve the problems. First, an activation gas made of a predetermined chemical material is introduced to a vacuum container and, after that, a plurality of electron-emitting devices are divided into a plurality of blocks. Repetitively applying a predetermined pulse voltage to a plurality of electron-emitting devices belonging to one block at the same time allows the electron-emitting devices in the block to be activated and the activation of the block is terminated.

After that, the activation operation is subsequently executed to blocks which are not yet activated. The activation operation for blocks is sequentially continuously performed and the activation for all of the electron-emitting devices is terminated. At that time, the number of electron-emitting devices in each block is increased, so that the number of electron-emitting devices to be simultaneously activated is increased. Consequently, the necessary time for the activation operation for the whole electron source can be reduced. Accordingly, the manufacturing costs can be suppressed to a low price.

Since the vacuum container constructs the image-forming apparatus, the vacuum container is connected to a vacuum exhausting system in various vacuum processes including the activation process and, after completion of the vacuum process, the container is separated from the vacuum exhausting system and functions solely as an image-forming apparatus. Therefore, the container has a narrow cylindrical exhaust pipe made of glass for connection with the vacuum exhausting system and it is necessary to introduce the activation gas to the vacuum container through the exhaust pipe.

In the case where the activation operation for each block comprising the plurality of electron-emitting devices is continuously executed, however, when the large number of electron-emitting devices are simultaneously activated, the activation gas in the vacuum container is consumed for the activation operation for the large number of devices at the initial stage of the activation and the amount is reduced, so that there is such a problem that the activation gas pressure in the vacuum container is fluctuated until the introduction volume of the activation gas is equivalent to the consumption.

FIG. 20 shows an example. In FIG. 20, the axis of abscissa denotes time when the blocks are sequentially activated continuously and the axis of ordinate indicates the activation gas pressure in the vacuum container. FIG. 20 shows that the activation gas pressure fluctuates at the initial stage of the activation by continuously activating the blocks and, after that, the pressure is stabilized, namely, a stability region follows.

Consequently, the electron-emitting properties of the electron emitting devices which belong to the block activated initially in the activation procedure are different from those of the electron-emitting devices activated after that, so that there is caused such a problem that a variation in luminance of the image-forming apparatus is generated.

The above problem tends to occur more frequently as the image-forming apparatus increases in size and the number of electron-emitting devices which are simultaneously subjected to the activation operation increases. In future realization of the increase in size of the image-forming apparatus, it is beginning to be highlighted as a very serious problem.

SUMMARY OF THE INVENTION

The present invention is made in consideration of the above problems included in the related arts and it is an object of the present invention to provide a method for manufacturing an electron source in which a variation in luminance can be suppressed and activation operation time for the whole electron source comprising a large number of electron-emitting devices can be reduced.

According to the present invention, there is provided a method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation for the plurality of electron-emitting devices is performed in such a manner that the activation operation is divided into a plurality of steps of first to final activation steps, the plurality of electron-emitting devices are divided into operation units each comprising a plurality of device groups, the first activation step of the activation operation is sequentially executed from an arbitrary operation unit, the first activation step for all of the operation units is terminated, after that, the plurality of electron-emitting devices are divided into operation units each comprising a plurality of device groups in a manner similar to the first activation step, the next activation step for all of the operation units is terminated, and such a procedure is repeated to execute up to the final activation step.

According to the present invention, there is provided a method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation is divided into a plurality of steps and then performed to the same electron-emitting device, the activation operation divided into the plurality of steps has a pause time during which the activation operation is not performed between the activation operation steps for the same electron emitting device, waveform conditions of the pulse voltage at the initial stage of the activation operation in the next step to be performed after the pause time are made different from those of the pulse voltage at the final stage of the activation operation in the preceding step.

DETAILED DESCRIPTION OF THE PREFERRED EMBODIMENTS

Figure 1A:
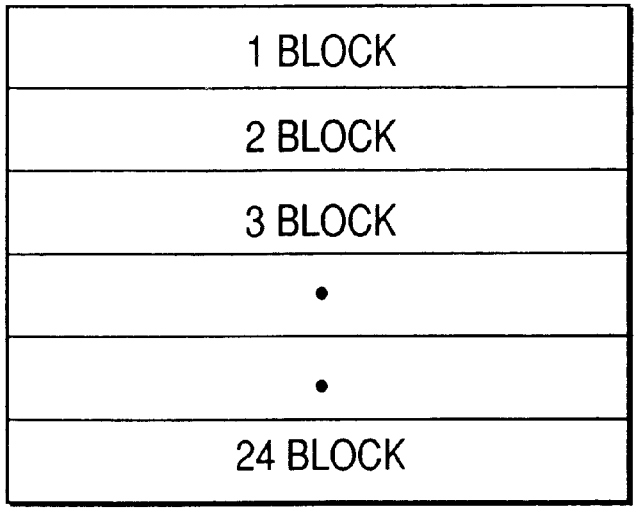
FIGS. 1A and 1B are a schematic view of an electron source substrate in an embodiment of the present invention and a schematic view showing an activation procedure divided into steps, respectively.

According to the present invention, there is provided a method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation for the plurality of electron-emitting devices is performed in such a manner that the activation operation is divided into a plurality of steps of first to final activation steps, the plurality of electron-emitting devices are divided into operation units each comprising a plurality of device groups, the first activation step of the activation operation is sequentially executed from an arbitrary operation unit, the first activation step for all of the operation units is terminated, after that, the plurality of electron-emitting devices are divided into the operation units each comprising a plurality of device groups in a manner similar to the first activation step, the next activation step for all of the operation units is terminated, and such a procedure is repeated to execute up to the final activation step.

Preferably, the plurality of electron-emitting devices are divided into groups comprising a plurality of device groups, the operation unit is constituted of at least two groups of the plurality of groups, and the pulse voltage is applied to each group in the activation step.

Preferably, on the basis of an application time of the pulse voltage necessary for the activation operation, the activation operation is divided into a plurality of steps in which the application time is divided.

The activation operation is preferably divided into a plurality of steps on the basis of a change in value of a current running through the electron-emitting devices, which varies depending on the progress of the activation operation.

The activation operation is preferably divided into a plurality of steps on the basis of the partial pressure of an activation gas in the atmosphere containing the organic material, in which the activation operation is performed.

Preferably, the activation operation is performed in such a state where a plurality of electron-emitting devices are arranged in a container and an activation gas containing the organic material is introduced into the container, and the introduction pressure of the activation gas to the container is equal to or less than $1\times10^{-4}$ Torr.

Preferably, each group includes the plurality of electron-emitting devices connected by a common wirings and the pulse voltage is applied to each group from one end or both ends of the common wiring.

Preferably, the plurality of electron-emitting devices are connected in a matrix form by a plurality of row-directional wirings and a plurality of column-directional wirings and the pulse voltage is sequentially applied to the plurality of electron-emitting devices every row-directional wiring or column-directional wiring.

According to the present invention, there is provided a method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation is divided into a plurality of steps and then performed to the same electron-emitting device, the activation operation divided into the plurality of steps has a pause time during which the activation operation is not performed between the activation operation steps for the same electron emitting device, waveform conditions of the pulse voltage at the initial stage of the activation operation in the next step to be performed after the pause time are made different from those of the pulse voltage at the final stage of the activation operation in the preceding step.

According to the present invention, there is provided a method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation is divided into a plurality of steps and then performed to the same electron-emitting device, the activation operation divided into the plurality of steps changes the kind of the organic material in the atmosphere between the activation operation steps for the same electron emitting device, and waveform conditions of the pulse voltage at the initial stage of the activation operation in the next step to be performed after the change of the kind of the organic materials in the atmosphere are made different from those of the pulse voltage at the final stage of the activation operation in the preceding step.

According to the present invention, there is provided a method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation is divided into a plurality of steps and then performed to the same electron-emitting device, the activation operation divided into the plurality of steps changes the partial pressure of a gas made of the organic material in the atmosphere between the activation operation steps for the same electron emitting device, and waveform conditions of the pulse voltage at the initial stage of the activation operation in the next step to be performed after the change of the partial pressure of the gas made of the organic material in the atmosphere are made different from those of the pulse voltage at the final stage of the activation operation in the preceding step.

Preferably, the value of a device current running through the electron-emitting devices is detected at the time of executing the activation operation, and the waveform conditions of the pulse voltage at the initial stage of the activation operation in the next step are changed on the basis of the device current value.

Preferably, the waveform conditions of the pulse voltage after the initial stage of the activation operation in the next step are set to those of the pulse voltage at the final stage of the activation operation in the preceding step.

Preferably, the waveform conditions of the pulse voltage, being made different at the initial stage of the activation operation in the next step, denote a pulse peak value.

Preferably, the pulse peak value of the pulse voltage, being made different at the initial stage of the activation operation in the next step, is set so as to be smaller than that of the pulse voltage at the final stage of the activation operation in the preceding step.

Preferably, the pulse peak value of the pulse voltage, being made different at the initial stage of the activation operation in the next step, is set so as to be smaller than that of the pulse voltage at the final stage of the activation operation in the preceding step and so as to be equal to or larger than ½ of the peak value.

Preferably, the waveform conditions of the pulse voltage, being made different of the pulse voltage at the initial stage of the activation operation in the next step, denote a pulse width.

Preferably, the pulse width of the pulse voltage, being made different at the initial stage of the activation operation in the next step, is set so as to be smaller than that of the pulse voltage at the final stage of the activation operation in the preceding step.

Preferably, the waveform conditions of the pulse voltage, being made different at the initial stage of the activation operation in the next step, denote a pulse waveform itself.

There is provided an image-forming apparatus comprising: an electron source manufactured on the basis of the above-mentioned method for manufacturing an electron source; and an image-forming member for forming an image by irradiating electrons emitted from the electron source.

When the manufacturing method is applied, even if the pressure of the activation gas in the atmosphere varies in association with the activation operation at the time of executing the activation operation for the electron source, the whole electron-emitting devices are subjected to the activation operation of respective steps substantially at the same time, so that it can be realized that the electron source is hardly influenced by a change in atmosphere.

In other words, a variation in respective electron-emitting properties of the plurality of electron-emitting devices due to fluctuation of the atmosphere, serving as a conventional problem, can be suppressed and a variation in luminance in the image-forming apparatus, serving as a problem when the electron source is applied to the image-forming apparatus, can be suppressed.

Embodiments of the present invention will now be described in detail hereinbelow with reference to the drawings. The present invention particularly relates to a procedure to perform the above-mentioned activation operation in the manufacturing process for the plurality of electron-emitting device arranged in the electron source.

In the following embodiments, the structure of the electron-emitting device and method of manufacturing as a whole, electron source using the plurality of devices, activation operation for the electron source as characteristics of the present invention, and construction of the image-forming apparatus using the electron source will now be described in accordance with this order.

Electron-emitting Device

As fundamental constructions, an electron-emitting device according to the present embodiment is largely classified into two types, namely, a plane type one and a step type one. The plane type electron-emitting device will now be described hereinbelow with reference to the drawings.

Structure of Plane Type Electron-emitting Device

Figure 6A:
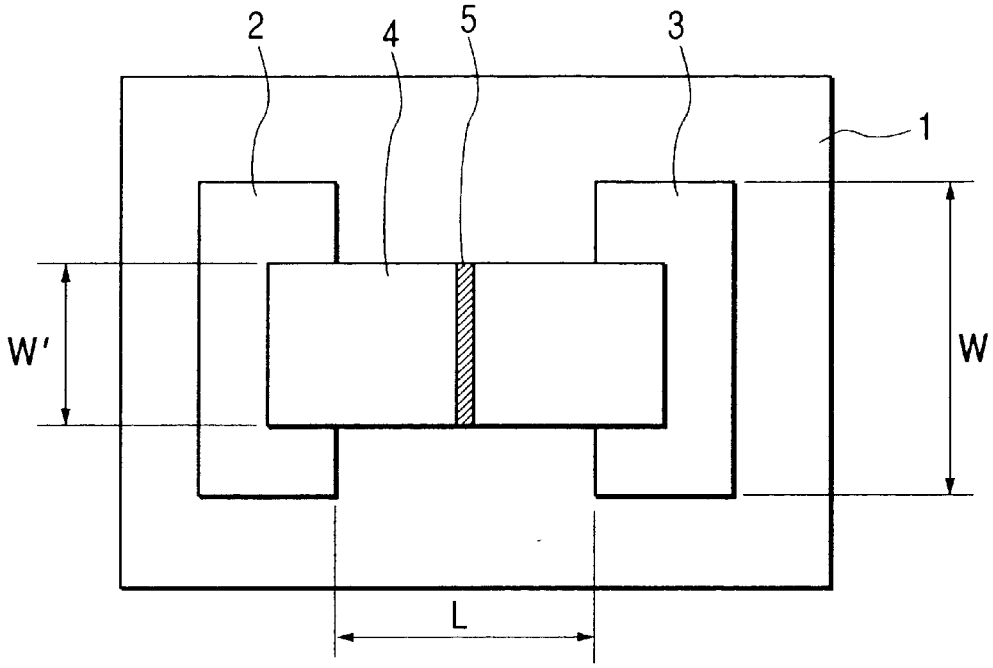
FIGS. 6A and 6B are schematic constructional views of a plane type electron-emitting device applicable to the present invention.
Figure 6B:
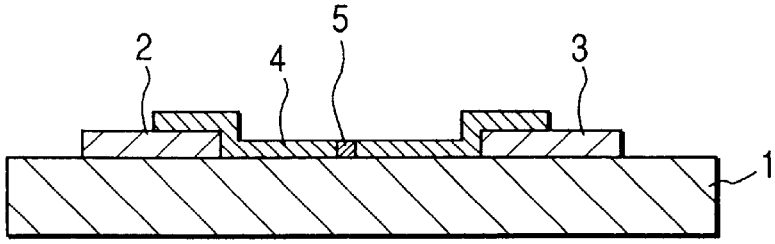

FIGS. 6A and 6B are schematic views each showing a construction of a plane type electron-emitting device to which the present invention can be applied. FIG. 6A is a plan view and FIG. 6B is a cross-sectional view. Referring to FIGS. 6A and 6B, reference numeral 1 denotes a substrate; 2 and 3 device electrodes; 4 an electroconductive thin film; and 5 an electron-emitting region.

As a substrate 1, quartz glass, glass in which the content of impurity such as Na is reduced, soda lime glass, a glass substrate obtained by depositing $SiO_2$ formed by a sputtering method or the like to the soda lime glass, ceramics made of alumina, and an Si substrate can be used.

As a material for the device electrodes 2 and 3 which face each other, a general conductive material can be used. The material can be properly selected from conductive material such as printed conductor made of metal or alloy of Ni, Cr, Au, Mo, W, Pt, Ti, Al, Cu, and Pd, or made of metal or metallic oxide of Pd, Ag, Au, $RuO_2$, and Pd-Ag and glass, transparent electroconductor made of $In_2O_3$—$SnO_2$, and semiconductor made of polysilicon.

As for an interval L between the device electrodes, the length W of the device electrode, and the form of the electroconductive thin film 4, they are designed in consideration of the form and the like to which the invention is applied. The device electrode interval L can be preferably set within a range of hundreds of nm to hundreds of $\mu$m, more preferably, within a range of several $\mu$m to tens of $\mu$m.

In consideration of a resistance value of the electrode and electron-emitting properties, the device electrode length W can be set within a range of several $\mu$m to hundreds of $\mu$m. The film thickness d of each of the device electrodes 2 and 3 can be set within a range of tens of nm to several $\mu$m.

The device is not limited to the construction shown in FIGS. 6A and 6B but it can also be constructed in such a manner that on the substrate 1, the electroconductive thin film 4 is laminated and the device electrodes 2 and 3 are then formed.

For the electroconductive thin film 4, in order to obtain fine electron-emitting properties, it is desirable to use a fine particle film composed of fine particles. The film thickness is appropriately set in consideration of step coverage to the device electrodes 2 and 3, resistance value between the device electrodes 2 and 3, and forming conditions which will be described hereinlater.

Generally, the film thickness of the electroconductive thin film 4 is preferably set within a range of several times of 0.1 nm to hundreds of nm, more preferably, within a range of 1 nm to 50 nm. The resistance value obtained when Rs is set to $10^3$ to $10^7$ Ω/□ is preferably used. Rs is a value that appears when the resistance R of the thin film having a thickness t, a width w, and a length 1 is expressed in an equation of R=Rs(1/w).

In the present embodiment, although the forming operation will be explained with respect to an energization operation as an example, the forming operation is not limited to it. The forming operation includes an operation for forming a high-resistant state by generating a fissure in the film.

A material constituting the electroconductive thin film 4 are properly selected from metal such as Pd, Pt, Ru, Ag, Au, Ti, In, Cu, Cr, Fe, Zn, Sn, Ta, W, or Pd, oxide such as PdO, $SnO_2$, $In_2O_3$, PbO, or $Sb_2O_3$, boride such as $HfB_2$, $ZrB_2$, $LaB_6$, $CeB_6$, $YB_4$, or $GdB_4$, carbide such as TiC, ZrC, HfC, Ta, C, SiC, or WC, nitride such as TiN, ZrN, or HfN, a semiconductor such as Si or Ge, and carbon.

The fine particle film described in this case is a film made by gathering a plurality of fine particles. Its fine structure is in a state where the fine particles are arranged so as to be separately dispersed or arranged so as to be adjacent to each other or overlap each other (also including a state where several fine particles gather to form island-like structures as a whole). The grain diameter of each fine particle is set within a range of several times of 0.1 nm to hundreds of nm, preferably, within a range of 1 nm to 20 nm.

The electron-emitting region 5 is constructed by a high-resistant fissure formed in a part of the electroconductive thin film 4 and depends on the film thickness of the electroconductive thin film 4, film quality, material, and methods such as energization forming and the like which will be described hereinlater. In an internal portion of the electron-emitting region 5, electroconductive fine particles each having a grain diameter within a range of several times of 0.1 nm to tens of nm exist in some cases. The electroconductive fine particles are one part of the elements of the materials constituting the electroconductive thin film 4 or contain all of the elements.

The electron-emitting region 5 and the electroconductive thin film 4 near the region can also contain carbon and a carbon compound.

Structure of Step Type Electron-emitting Device

The step type electron-emitting device will now be described.

Figure 7:
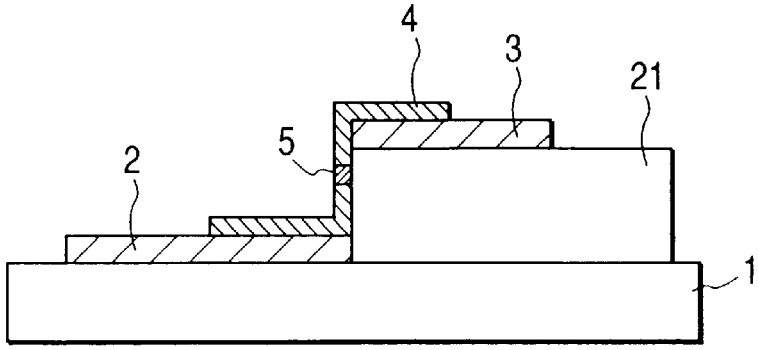
FIG. 7 is a schematic constructional view of a step type electron-emitting device applicable to the present invention.

FIG. 7 is a schematic view showing an example of a step type electron-emitting device to which the electron-emitting device of the present invention can be applied. In FIG. 7, the same parts as those shown in FIGS. 6A and 6B are designated by the same reference numerals as those in FIGS. 6A and 6B. Reference numeral 21 denotes a step-forming section.

Since the substrate 1, device electrodes 2 and 3, electroconductive thin film 4, and electron-emitting region 5 can be constructed by the materials similar to those in the case of the above-mentioned plane type electron-emitting device, the detail description is omitted.

The step-forming section 21 can be constructed by an insulating material such as $SiO_2$ formed by a vacuum evaporating method, a printing method, or sputtering method. The film thickness of the step-forming section 21 corresponds to the device electrode interval L of the above-mentioned plane type electron-emitting device and can be set within a range of hundreds of nm to tens of $\mu$m. Although the film thickness is set in consideration of the manufacturing method of the step-forming section and a voltage to be applied between the device electrodes, it is preferably set within a range of tens of nm to several $\mu$m.

After the device electrodes 2 and 3 and the step-forming section 21 are formed, the electroconductive thin film 4 is formed on the device electrodes 2 and 3. Referring to FIG. 7, although the electron-emitting region 5 is formed on the step-forming section 21, the formation of the region depends on the depositing conditions and the forming conditions. The form and position are not limited to those in FIG. 7.

Method of Manufacturing Electron-emitting Device

Figure 8A:
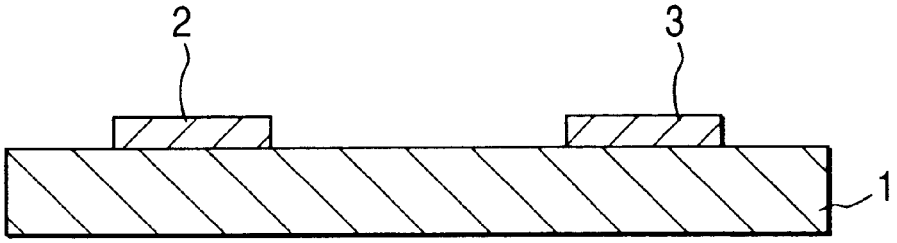
FIGS. 8A, 8B, and 8C are views for explaining a manufacturing process of the electron-emitting device applicable to the present invention.
Figure 8B:
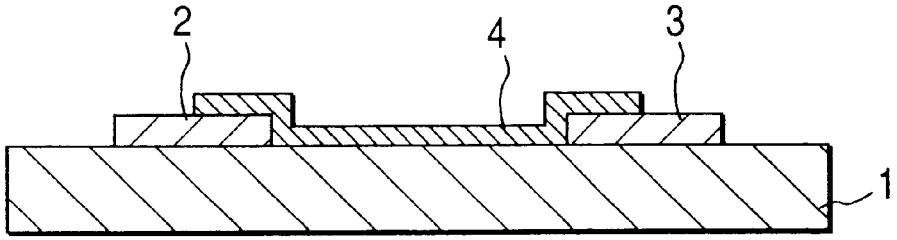
Figure 8C:
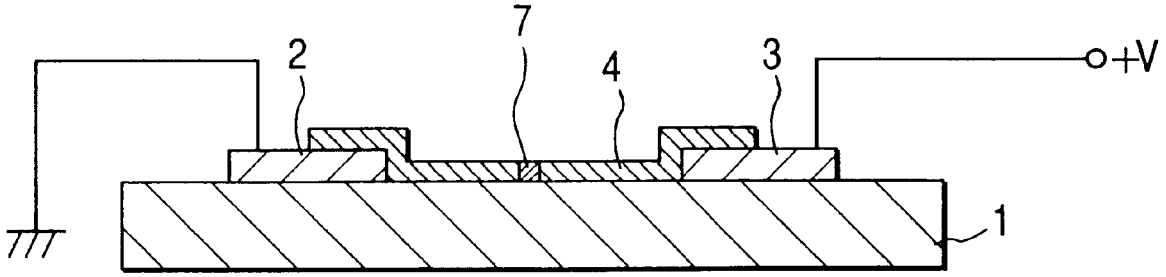

As methods of manufacturing the above-mentioned electron-emitting devices, there are various methods. An example among them is schematically shown in FIGS. 8A to 8C. An example of the manufacturing method will now be described hereinbelow with reference to FIGS. 6A and 6B and 8A to 8C. Referring to FIGS. 6A and 6B, the same parts as those shown in FIGS. 8A to 8C are designated by the same reference numerals as those in FIGS. 6A and 6B.

1) The substrate 1 is cleansed enough by using a detergent, pure water, and an organic solution. After a material for the device electrode is deposited to the substrate 1 by the vapor depositing method or sputtering method, the device electrodes 2 and 3 are formed on the substrate 1 by using, for example, a photolithography technique (FIG. 8A).
2) An organic metallic solution is applied to the substrate 1 on which the device electrodes 2 and 3 are formed to form an organic metal thin film. As an organic metallic solution, a solution made of an organic metallic compound containing metal of the material for the above-mentioned electroconductive film 4 as a main element can be used.

Further, the organic metal thin film is heated and calcined, and then patterned by a lift-off or an etching to form the electroconductive thin film 4 (FIG. 8B). In this case, the applying method of the organic metallic solution has been described as an example. The forming method of the electroconductive thin film 4 is not limited to it but the vapor depositing method, sputtering method, a chemical vapor deposition method, a diffusion coating method, a dipping method, and a spinner method can also be used.

3) Subsequently, a forming process is performed. As an example of methods for the forming process, a method due to an energization operation will be explained. When the portion between the device electrodes 2 and 3 is energized by using a power source (not shown), the electron-emitting region 5 in which the structure is changed is formed in one part of the electroconductive thin film 4 (FIG. 8C). Due to the energization forming, the electroconductive thin film 4 is partially destroyed, deformed, or changed in properties, namely, a part in which the structure is changed is formed in the electroconductive thin film 4. The electron-emitting region 5 is comprised of the relevant part.

Figure 9A:
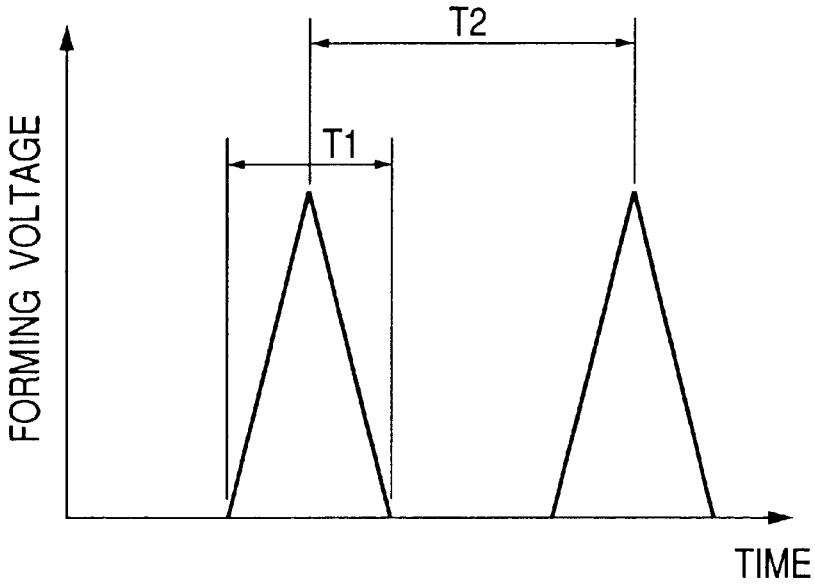
FIGS. 9A and 9B are schematic graphs each showing an example of a voltage waveform in an energization forming operation for the electron-emitting device applicable to the present invention.
Figure 9B:
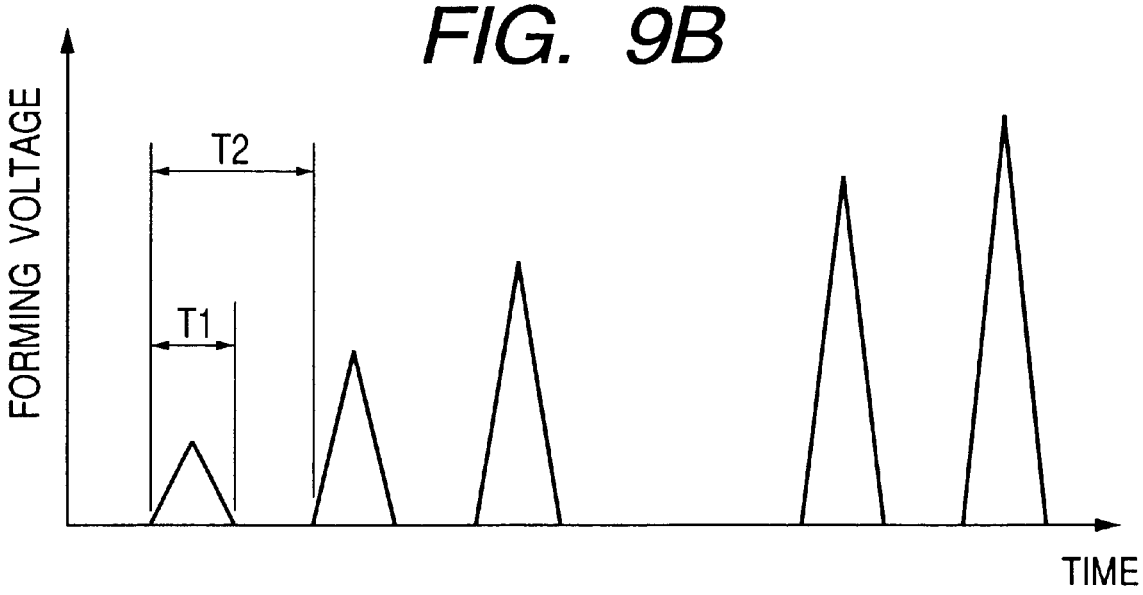

FIGS. 9A and 9B show examples of voltage waveforms of the energization forming. As a voltage waveform, a pulse-shaped waveform is desirable. In order to obtain the pulse waveform, there are a method for continuously applying pulses in which a pulse peak value is set to a constant voltage shown in FIG. 9A and a method for applying voltage pulses while increasing a pulse peak value shown in FIG. 9B.

Referring to FIG. 9A, reference symbol T1 denotes a pulse width of the voltage waveform and reference symbol T2 indicates a pulse interval. Generally, T1 is set within a range of 1 sec. to 10 msec. and T2 is set within a range of 10 sec. to 10 msec. The peak value with a triangular waveform (peak voltage upon energization forming) is properly selected in correspondence to the form of the surface conduction electron-emitting device. Under such conditions, for example, the voltage is applied for several seconds to tens of minutes. The pulse waveform is not limited to the triangle waveform but a desired waveform such as a rectangular waveform can be used.

Referring to FIG. 9B, reference symbols T1 and T2 can be set similar to those shown in FIG. 9A. The peak value with a triangular waveform (peak voltage upon energization forming) can be increased by, for example, about 0.1 V at each pulse.

The end of the energization forming operation can be detected by applying a voltage of such a degree that the electroconductive thin film 2 is not partially destroyed or deformed and measuring a current during the pulse interval T2. For example, a device current which flows by applying a voltage of about 0.1 V is measured and a resistance value is obtained. When a resistance of 1 MΩ or more is shown, the energization forming is terminated.

4) It is preferable to carry out an operation called an activation process to the device after completion of the forming. The activation process is an operation to appropriately apply a voltage to the electron-emitting region formed by the energization forming operation to deposit carbon or a carbon compound near the electron-emitting region. Due to the activation, the properties of the device current If and the emission current Ie can be remarkably changed.

In this instance, the activation operation in the single electron-emitting device will be explained and a case where the activation operation is performed to the electron source having a plurality of electron-emitting devices will be described hereinlater.

Figure 10:
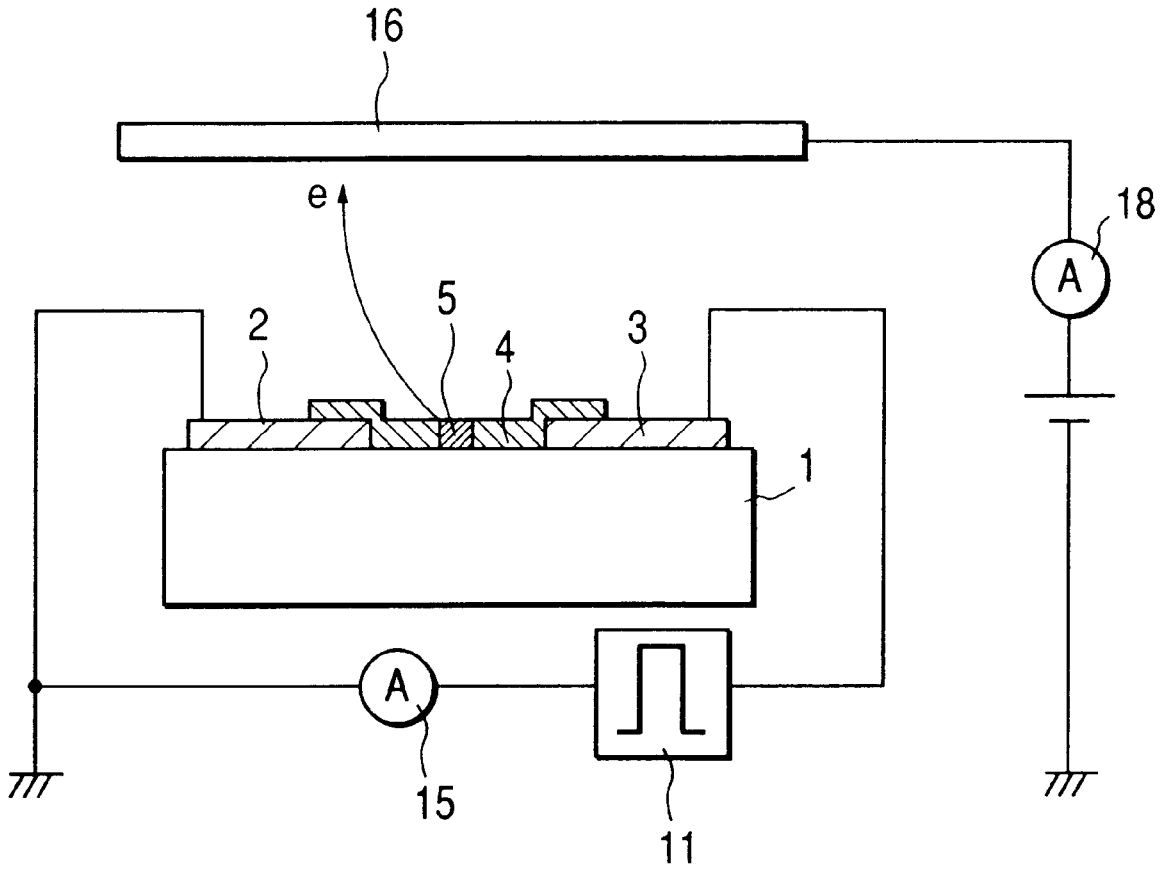
FIG. 10 is a schematic diagram showing an example of a vacuum processing apparatus having a measurement evaluating function.

FIG. 10 is a diagram for explaining the activation process in the electron-emitting device applicable to the present invention.

Referring to FIG. 10, an ammeter 15 measures the device current If which flows through the electron-emitting device. An anode electrode 16 picks up the emission current Ie which is emitted from the electron-emitting device. A direct-current (DC) high-voltage source 17 and an ammeter 18 are connected to the anode electrode 16 (in the case according to the present invention where the substrate 1 is built in a display panel and the activation operation is then performed, a fluorescent screen of the display panel is used as an anode electrode 16).

Figure 5:
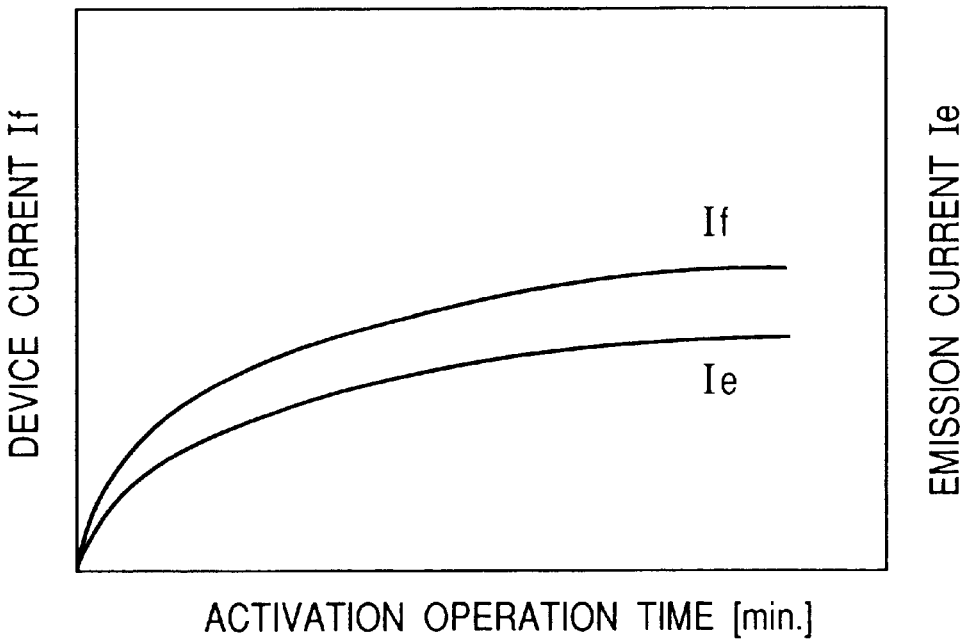
FIG. 5 is a graph showing an aging change in device current If and Ie upon activation operation in the electron-emitting device applicable to the present invention.

For example, in an atmosphere containing a gas made of an organic material, the activation operation can be performed by repetitively applying a proper voltage pulse from an activation voltage source 11 to the portion between the device electrodes. More specifically, the device current If and emission current Ie are measured by the ammeters 15 and 18 for a period of time during which the voltage is applied from the activation voltage source 11, thereby monitoring the progress of the activation. FIG. 5 shows an example of the relation between the device current If and the emission current Ie measured by the ammeters 15 and 18. When the activation voltage source 11 starts to apply the pulse voltage, the device current If and the emission current Ie increase in association with the elapse of time, both of them are saturated soon, and they scarcely increase. As mentioned above, the voltage application from the activation voltage source is stopped at the time point when the device current If and emission current Ie are substantially saturated and the activation operation is terminated. In case of the electron-emitting device to which the activation operation is performed as mentioned above, the device current is generally set to about 100 μA to tens of mA. It is clarified that the device current If increases in association with the activation by the activation operation and the emission current Ie is remarkably increased.

Figure 4:
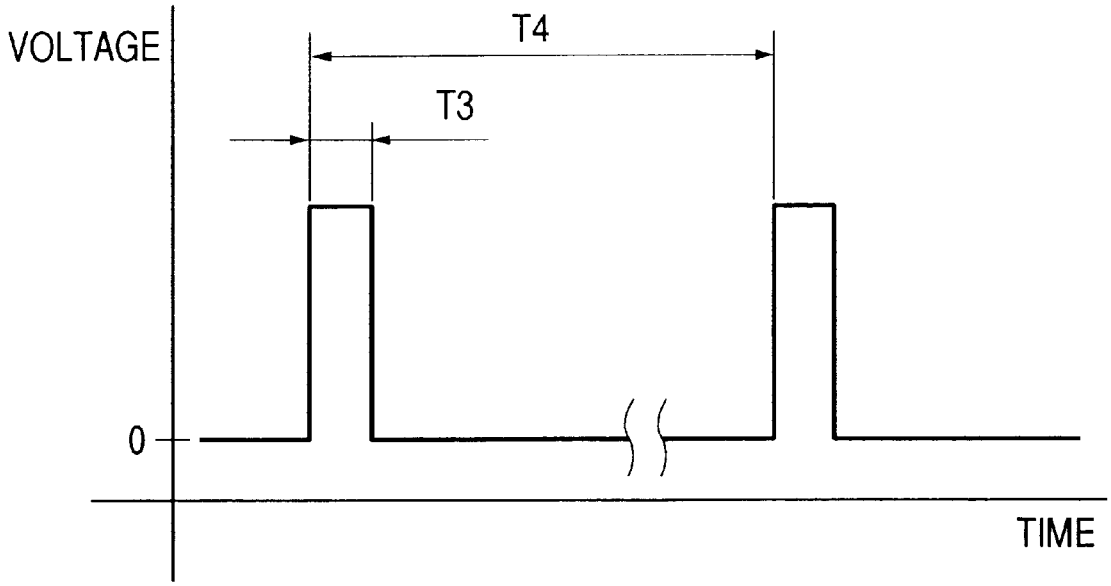
FIG. 4 is a schematic graph showing an example of a pulse voltage waveform at the time of the activation operation for an electron-emitting device applicable to the present invention.

FIG. 4 is a diagram showing an example of an output waveform of the activation voltage source in the activation operation as an embodiment of the present invention.

Referring to FIG. 4, reference symbol T3 denotes a pulse width of the voltage waveform and reference symbol T4 indicates a pulse interval. Generally, T3 is set within a range of 1 μsec to 10 msec and T4 is set within a range of 10 μsec to 100 msec. In the example of FIG. 4, the activation operation is performed by periodically applying a predetermined voltage having a rectangular waveform to the electroconductive thin film 4. The voltage and waveform are not limited to them but conditions can be properly changed in correspondence to a desired electron-emitting device.

As for a ratio (duty ratio) of the pulse width to the period of the voltage pulse, when the ratio is reduced too much, an increase of the device current If and emission current Ie is hardly shown and it tends to hardly activate, so that electron-emitting properties after the activation, particularly, the emission current Ie is reduced in many cases. The duty ratio upon activation is preferably set to about 1/100 to ½ although it depends on the activation material.

The above-mentioned atmosphere containing a gas made of the organic material can be formed by using an organic gas remained in an atmosphere in the case where a vacuum container is exhausted by using, for example, an oil diffusion pump or a rotary pump. In addition, it can be obtained by introducing a gas made of a proper organic material into a vacuum obtained by once exhausting enough through an ion pump.

As for a preferable pressure of the gas made of the organic material at this time, since it varies depending on the above-mentioned application form, form of the vacuum container, kind of the organic material, it is properly set in accordance with the case. When an introduction pressure of the organic material gas is equal to or less than $1\times10^{-4}$ Torr, the present invention exhibits the effectiveness.

As a proper organic material, aliphatic hydrocarbons such as alkane, alkene, and alkyne, aromatic hydrocarbons, alcohols, aldehydes, ketones, amines, phenol, carboxylic acids, and organic acids such as sulfonic acid can be mentioned. Specifically, saturated hydrocarbon such as methane, ethane, and propane expressed by $C_nH_{2n+2}$, unsaturated hydrocarbon such as ethylene and propylene expressed by composition formula of $CnH_{2n}$, benzene, toluene, methanol, ethanol, formaldehyde, acetic aldehyde, acetone, methyl ethyl ketone, methylamine, ethylamine, phenol, formic acid, acetate, and propionic acid can be used.

According to the present invention, those organic materials can be used solely or can be mixedly used as necessary.

According to the operation, a film containing carbon, being made of carbon or a carbon compound, can be deposited on the device from the organic material existing in the atmosphere, so that the properties of the device current If and emission current Ie can be remarkably changed.

In this case, the carbon and carbon compound denote, for example, graphite (containing the so-called HOPG, PG, and GC: HOPG is a crystalline structure of substantially complete graphite; PG is a structure in which each crystalline grain is equal to about 200Å and the crystalline structure is slightly disordered; and GC is a structure in which each crystalline grain is equal to about 20Å and the crystalline structure is further disordered) or non-crystalline carbon (indicative of amorphous carbon and a mixture of amorphous carbon and fine crystals of the graphite). The film thickness is preferably set to 50 nm or less, more preferably, 30 nm or less.

The determination regarding the end of the activation operation is appropriately performed while the device current If and the emission current Ie are measured.

5) It is preferable to perform a stabilization process to the electron-emitting device obtained through such processes. The process is a process to exhaust the organic material in the vacuum container. As an evacuating apparatus for exhausting the vacuum container, it is preferable to use one without using oil so that the properties of the device are not influenced by oil generated from the apparatus. Specifically, an evacuating apparatus such as absorption pump or ion pump can be used.

When the oil diffusion pump or rotary pump is used as an exhausting apparatus in the activation operation and an organic gas caused from an oil component generated from the apparatus is used, it is necessary to suppress the partial pressure of the component as low as possible. As a partial pressure of the organic component in the vacuum container, it is preferable to set a partial pressure at which the above carbon and carbon compound are not newly deposited to $1\times10^{-8}$ Torr or less, more preferably, $1\times10^{-10}$ Torr or less. When the vacuum container is exhausted, it is preferable to heat the whole of the vacuum container so that organic material molecules adsorbed on the internal walls of the vacuum container or electron-emitting device are easily exhausted. As heating conditions at that time, it is preferable to set a temperature to 80 to 250° C., more preferably, 150° C. or more. It is desirable to process as long as possible. The conditions are not particularly limited to those. Heating is performed under conditions which are properly selected under conditions such as size and form of the vacuum container and constitution of the electron-emitting device. It is necessary to set the pressure in the vacuum container as low as possible. It is preferable to set the pressure to $1\times10^{-7}$ Torr or less, more preferably, $1\times10^{-8}$ Torr or less.

As for the atmosphere upon driving after completion of the stabilization operation, it is preferable to maintain the atmosphere at the end of the stabilization operation. It is not limited to it. When the organic material is sufficiently eliminated, enough stable characteristics can be maintain so long as a degree of vacuum is slightly deteriorated.

When such a vacuum atmosphere is used, the deposition of new carbon and a new carbon compound can be suppressed and $H_2O$ and $O_2$ adsorbed on the vacuum container or substrate can be removed, so that the device current If and emission current Ie can be stabilized.

Fundamental properties of the electron-emitting device obtained through the above-mentioned processes, to which the present invention can be applied, will now be described with reference to FIGS. 11 and 12.

Figure 11:
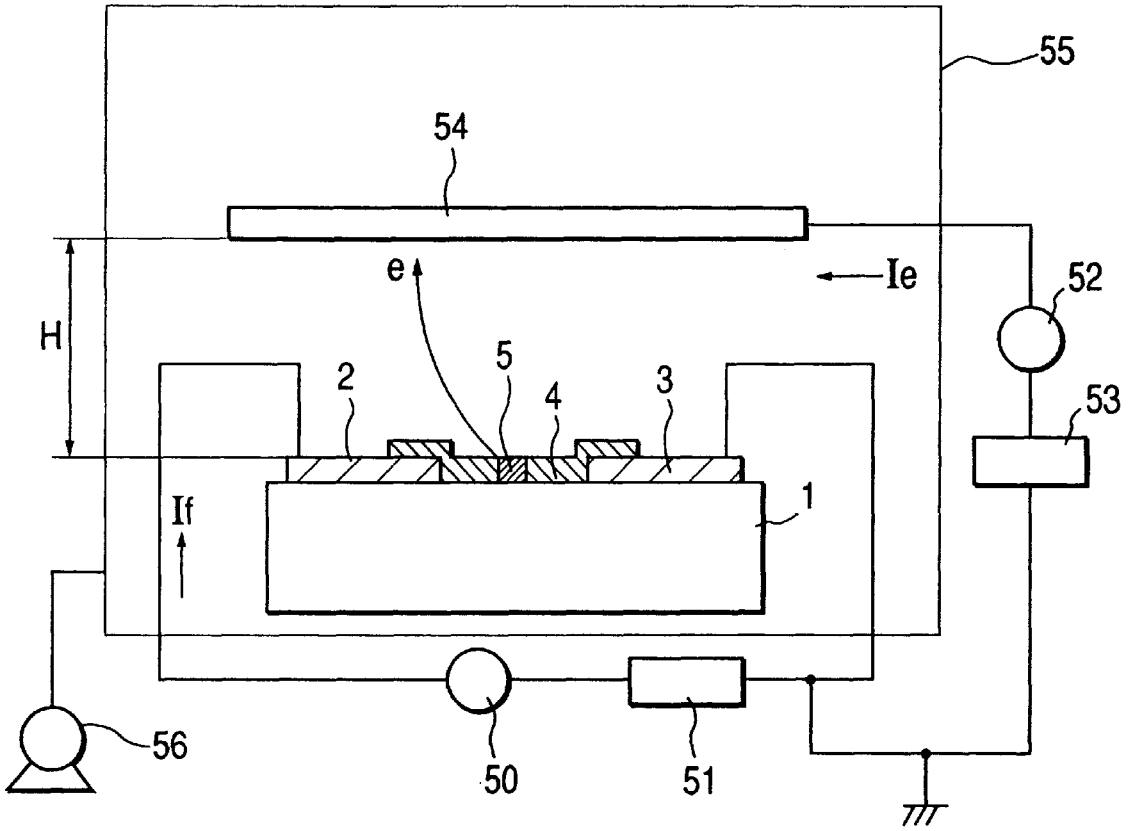
FIG. 11 is a diagram showing a state of the activation operation in the electron-emitting device applicable to the present invention.

FIG. 11 is a schematic diagram showing an example of a vacuum processing apparatus. The vacuum processing apparatus also has a function as a measurement evaluating apparatus. Referring to FIG. 11, the same parts as shown in FIGS. 6A and 6B are designated by the same reference numerals as those in FIGS. 6A and 6B.

Referring to FIG. 11, reference numeral 55 denotes a vacuum container and reference numeral 56 indicates an exhaust pump. An electron-emitting device is arranged in the vacuum container 55. That is, reference numeral 1 denotes the substrate constituting the electron-emitting device; 2 and 3 the device electrodes; 4 the electroconductive thin film; and 5 the electron-emitting region; 51 a power source to apply a device voltage Vf to the electron-emitting device; 50 an ammeter to measure the device current If which flows through the electroconductive thin film 4 between the device electrodes 2 and 3; 54 an anode electrode to pick up the emission current Ie emitted from the electron-emitting region of the device; 53 a high-voltage source to apply a voltage to the anode electrode 54; and 52 an ammeter to measure the emission current Ie emitted from the electron-emitting region 5 of the device. As an example, the measurement can be performed under such conditions that the voltage of the anode electrode is set within a range of 1 kV to 10 kV and a distance H between the anode electrode and the electron-emitting device is set within a range of 2 to 8 mm.

In the vacuum container 55, a device such as a vacuum gage (not shown) needed for the measurement in a vacuum atmosphere is arranged. It is possible to evaluate the measurement in a desired vacuum atmosphere.

The exhaust pump 56 comprises a normal high vacuum apparatus system composed of a turbo pump and a rotary pump and, further, an ultra-high vacuum apparatus system composed of an ion pump or the like. A heater (not shown) can heat the whole of the vacuum processing apparatus shown in the diagram, in which the electron source substrate is arranged. Therefore, the use of the vacuum processing apparatus enables the processes subsequent to the above-mentioned energization forming to be performed.

Figure 12:
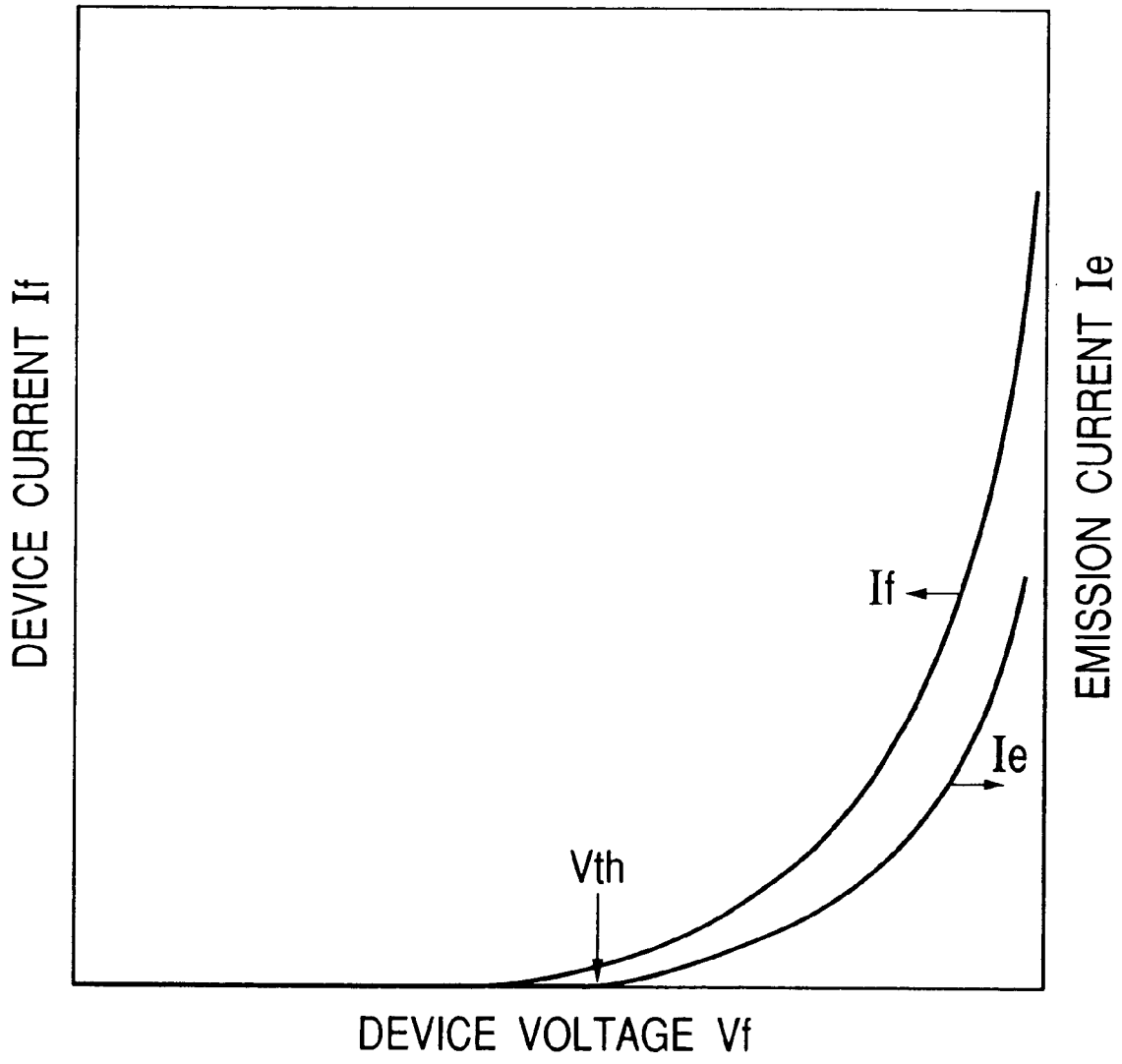
FIG. 12 is a graph showing a relation between the device current If and emission current Ie to a device voltage Vf regarding a surface conduction electron-emitting device applicable to the present invention.

FIG. 12 is a diagram schematically showing the relation between the emission current Ie, device current If, and device voltage Vf measured by using the vacuum processing apparatus shown in FIG. 11. Referring to FIG. 12, since the emission current Ie is remarkably smaller than the device current If, they are shown based on arbitrary units. The axis of ordinate and the axis of abscissa are based on a linear scale.

As will be understood from FIG. 12, the electron-emitting device used in the present invention has three distinctive properties for the emission current Ie.

That is,

1. When a device voltage that is equal to or larger than a certain voltage (referred to as a threshold voltage: Vth in FIG. 12) is applied to the present device, the emission current Ie sharply increases. On the other hand, when a voltage that is equal to the threshold voltage Vth or less is applied, the emission current Ie is hardly detected. In other words, the device is a non-linear device having the clear threshold voltage Vth for the emission current Ie.

2. Since the emission current Ie monotonically increases relative to the device voltage Vf, the emission current Ie can be controlled based on the device voltage Vf.
3. Since the emission current Ie monotonically increases relative to the device voltage Vf, the emission current Ie can be controlled based on the device voltage Vf.

As will be understood from the above description, as for the electron-emitting device used in the present invention, the electron-emitting properties can be easily controlled in accordance with an input signal. Utilizing the properties realizes the application to various aspects such as electron source constructed by arranging a plurality of electron-emitting devices and image forming apparatus.

FIG. 12 shows the example of the monotonic increase (hereinbelow, referred to as "MI characteristics") of the device current If for the device voltage Vf by a solid line. The device current If shows voltage control type negative resistant characteristics (hereinbelow, referred to as "VCNR characteristics") for the device voltage Vf in some cases (not shown). Those characteristics can be realized by controlling the above processes.

Image-forming Apparatus Having Electron-emitting Devices

An electron source constructed by arranging a plurality of above-mentioned electron-emitting devices on the substrate and an image-forming apparatus will now be described.

Figure 13:
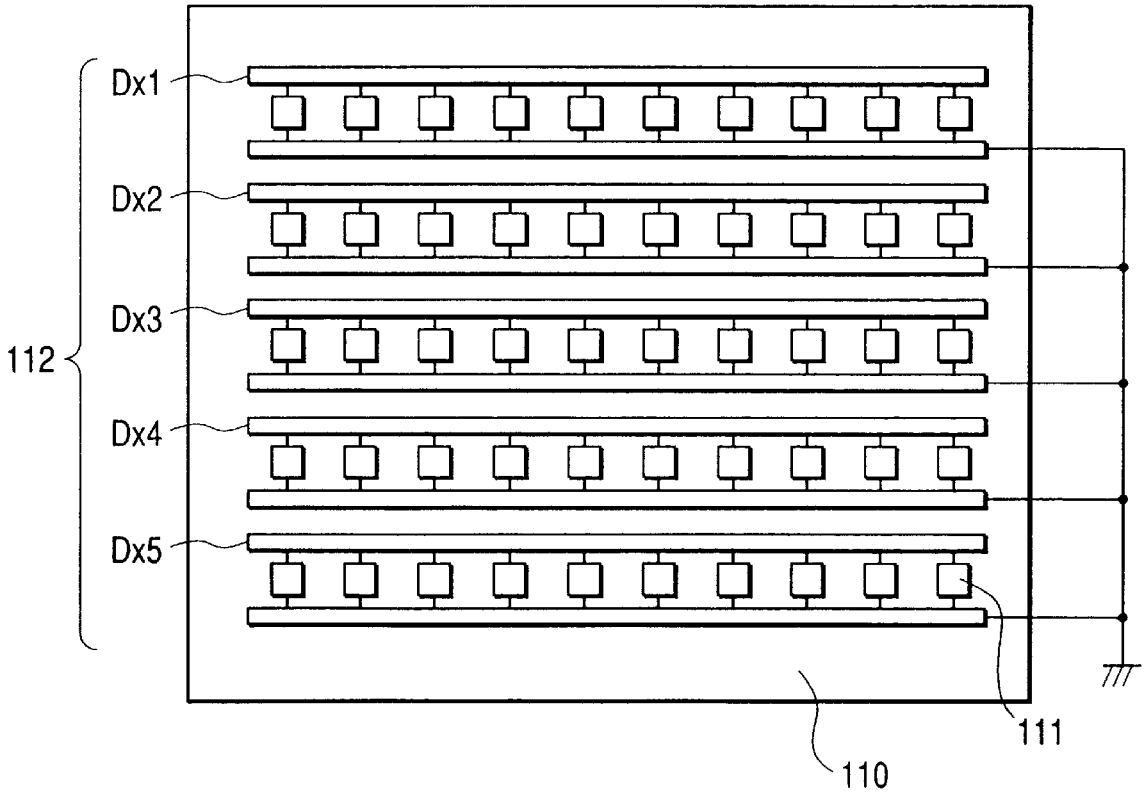
FIG. 13 is a schematic view showing an example of an electron source in a ladder-like arrangement to which the present invention can be applied.

Various arrays of the electron-emitting devices can be applied. As an example, as shown in FIG. 13, there is a ladder-like arrangement in which a large number of electron-emitting devices 111 are arranged in parallel on an electron source substrate 110 so that both terminals of respective devices are connected, a large number of rows each comprising the electron-emitting devices are arranged (referred to as a row direction), and control electrodes 112 (also called grids), being disposed above the electron-emitting devices, control electrons from the electron-emitting devices in the direction (referred to as a column direction) perpendicular to the row directional wirings. In addition, there is an arrangement in which a plurality of electron-emitting devices are arranged in X and Y directions in a matrix form, one of electrodes of each of a plurality of electron-emitting devices arranged in the same row is connected to the Y-directional wiring in common to other electrodes. Such an arrangement is the so-called simple matrix arrangement. First, the simple matrix arrangement will now be described in detail hereinbelow.

The electron-emitting device applicable to the present invention has the properties of 1. to 3. as mentioned above. That is, in case of the threshold voltage or more, the emission electrons from the electron-emitting devices can be controlled on the basis of the peak value and width of the pulse-shaped voltage applied between the device electrodes which are opposite to each other. On the other hand, in case of the threshold value or less, the electron is hardly emitted. According to the properties, even in the case where a large number of electron-emitting devices are arranged, when a pulse-shaped voltage is properly applied to the respective devices, the electron-emitting devices are selected in accordance with an input signal, so that an electron-emitting amount can be controlled.

On the basis of the principle, an electron source substrate obtained by arranging a plurality of electron-emitting devices applicable to the present invention will now be explained hereinbelow with reference to FIG. 14.

Figure 14:
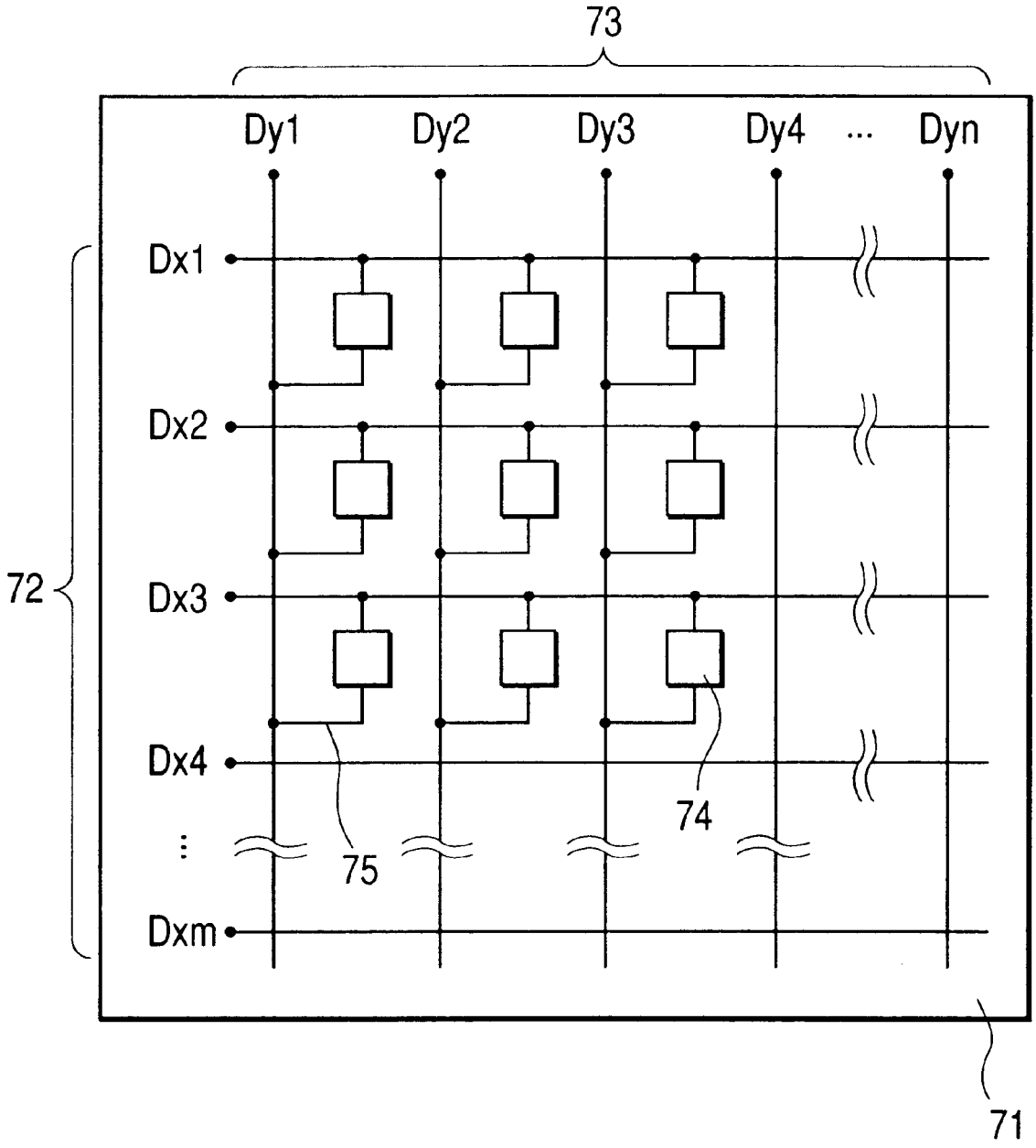
FIG. 14 is a schematic diagram showing an example of an electron source in a simple matrix arrangement to which the present invention can be applied.

FIG. 14 is a schematic diagram showing an example of the electron source with the simple matrix arrangement applicable to the present invention.

Referring to FIG. 14, reference numeral 71 denotes an electron source substrate; 72 X-directional wirings; 73 Y-directional wirings; 74 an electron-emitting device; and 75 a connection. As for the electron-emitting device 74, either the above-mentioned plane type one or the step type one can be used.

The X-directional wirings 72 include m X-directional wirings Dx1, Dx2, . . . , Dxm. They can be made of electroconductive metal formed by using the vapor depositing method, printing method, or sputtering method. The material, film thickness, and width of the wiring is properly designed. The Y-directional wirings 73 include n wirings Dy1, Dy2, . . . , Dyn. They are formed in a manner similar to the X-directional wirings 72. An interlayer insulating layer (not shown) is formed between the m X-directional wirings 72 and the n Y-directional wirings 73 so as to electrically isolate them from each other (each of m and n denotes a positive integer).

The interlayer insulating layer (not shown) is composed of $SiO_2$ or the like formed by using the vapor depositing method, printing method, or sputtering method. For example, the layer is formed in a desired form on the whole or part of the surface of the substrate 71 on which the X-directional wirings 72 are formed. Particularly, the film thickness, material, and manufacturing method are properly set so that the insulating layer can be resistant to a potential difference of each intersection of the X-directional wiring 72 and the Y-directional wiring 73. The X-directional wirings 72 and the Y-directional wirings 73 are led out as external terminals, respectively.

Respective pairs of electrodes (not shown) constituting the respective electron-emitting devices 74 are electrically connected by the m X-directional wirings 72, n Y-directional wirings 73, and the connections 75 made of electroconductive metal.

In regard of the material making the X-directional wiring 72 and the Y-directional wiring 73, material making the connection 75, and material making the pair of device electrodes, one part or whole of the respective constitutional elements may be the same or different elements can be used. Those materials are properly selected from, for example, the above-mentioned materials for the device electrode. When the material making the device electrode is the same as that for the wiring, the wiring connected to the device electrode can be used as a device electrode.

The above-mentioned forming voltage pulse is applied to the above-mentioned electron source substrate through the X-directional wirings and the Y-directional wirings to perform the forming operation, thereby forming the electron-emitting region in each device.

Activation Operation of Electron Source

The activation operating method of a multi-electron source in which a plurality of devices are arranged, serving as largest characteristics of the present invention, will now be described in detail.

A first embodiment will now be explained hereinbelow.

In the activation procedure, the voltage pulse is repetitively applied from the activation voltage source to the electron source substrate in an atmosphere including a gas made of the organic material through the X-directional wirings and Y-directional wirings, thereby performing the activation operation. In case of the multi-electron source in which a plurality of devices are arranged, as mentioned above, the normal activation operating method requires a very long activation time for the whole of electron source.

Consequently, the properties of the electron-emitting device initially activated are different from those of the electron-emitting device finally activated, so that such an adverse effect that uniformity is deteriorated is derived. Therefore, the activation operation for the multi-electron source is needed. The active operating method will now be described in detail hereinbelow with reference to the drawings.

FIG. 1A shows a schematic diagram of the electron source substrate in which a plurality of electron-emitting devices arranged in the same X-directional wiring in the foregoing electron source substrate are set as one group as a device group, I groups, namely, the electron-emitting devices arranged in I X-directional wirings form a block as one operation unit, and the electron source substrate are divided into M blocks.

Figure 1B:
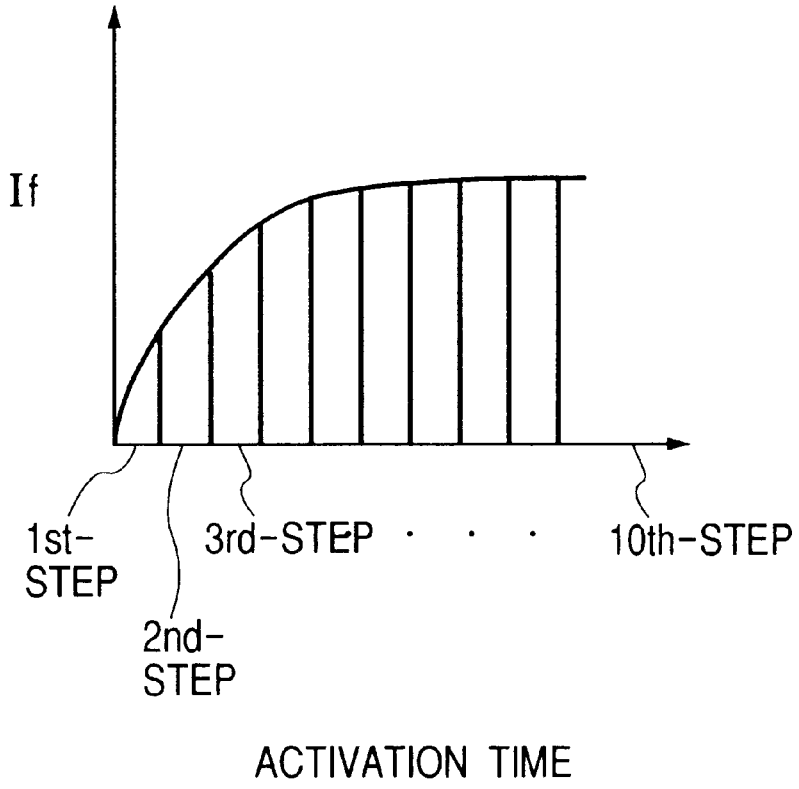

Referring to FIG. 1B, the axis of abscissa denotes an activation voltage application time when the activation operation is performed to each block and the axis of ordinate indicates the current If which flows through the electron-emitting devices of a certain block to schematically show If profile upon activation. In this case, as shown by the axis of abscissa of FIG. 1B, it is understood that the activation procedure is divided into a plurality of steps of a first activation step, a second activation step, . . . , and a final activation step every predetermined period.

Figure 2:
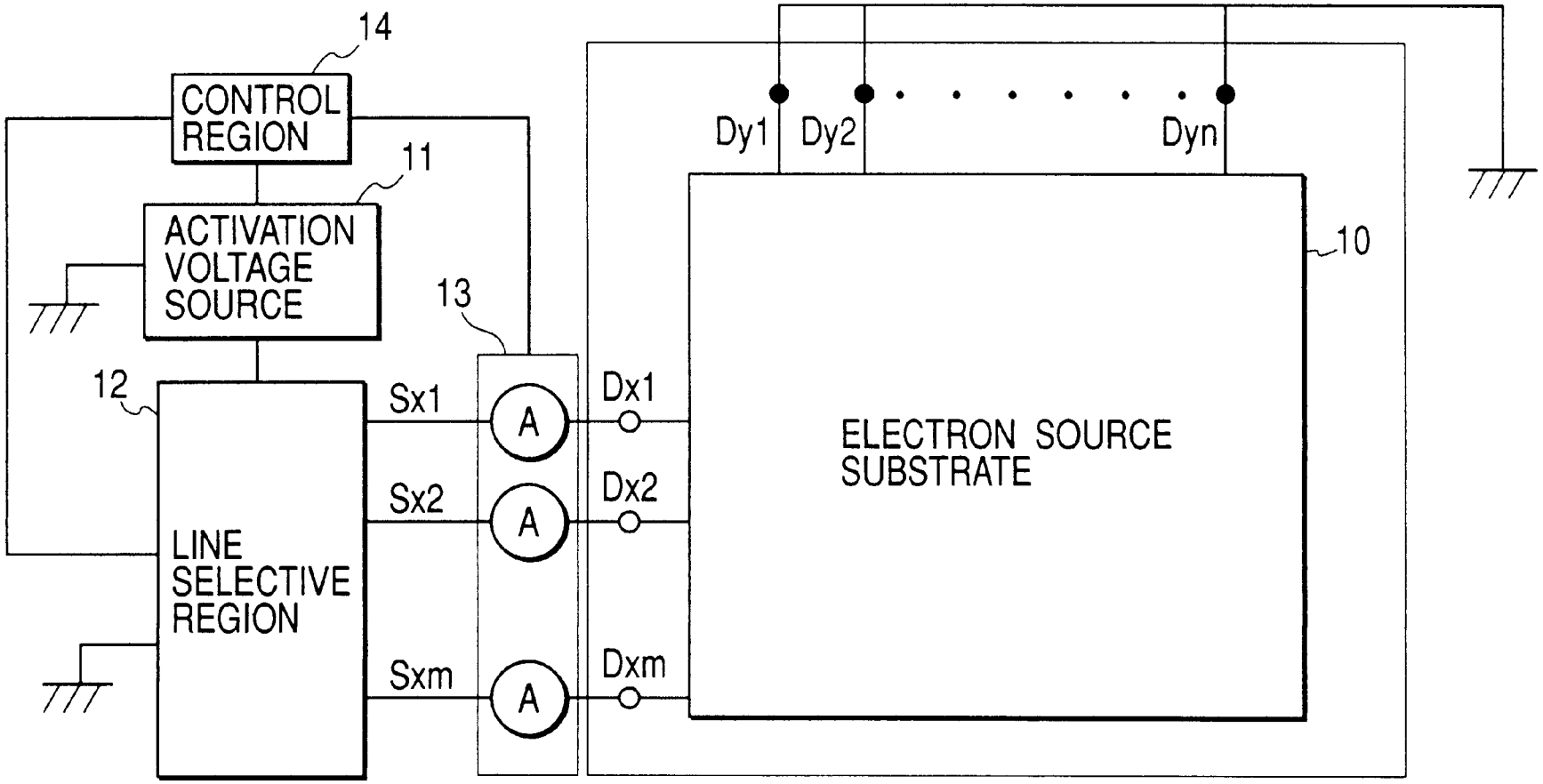
FIG. 2 is a diagram showing a construction of an activation apparatus according to the present invention.

FIG. 2 is an example of a block diagram showing a construction of an activation apparatus for the multi-electron source of the present invention. An activation voltage source 11 generates an activation voltage pulse. A line selection region 12 applies the voltage pulse generated in the activation voltage source to a necessary line. An ammeter 13 monitors the total current value of the device currents flowing through the electron-emitting devices arranged in each line. A control region 14 controls the activation voltage source 11 and the line selection region 12 on the basis of the device current value of one line detected by the ammeter 13 or a period of time during which the voltage is applied to each line. A plurality of electron-emitting devices to which the foregoing forming operation is performed are arranged in a simple matrix form of (m rows×n columns) on an electron source substrate 10. The electron source substrate 10 is disposed in a vacuum apparatus (not shown) in an atmosphere containing a gas made of an organic material. The X-directional wirings Dx1 to Dxm of the electron source substrate are connected to Sx1 to Sxm of the activation operation apparatus. In this example, a set of a plurality of electron-emitting devices arranged in one line, namely, the device group of one line is set to one group. The set of groups comprise a plurality of line device groups in each of which the electron-emitting devices are arranged. In this case, although one line in the row direction is defined as a group, one line in the column direction can be set as a group or a large number of lines can be considered as one group.

The activation method of the electron-emitting device of the present invention will now be explained hereinbelow with reference to FIGS. 1A and 1B and 2. The activation voltage source 11 generates a voltage pulse necessary for the activation. In the present embodiment, the activation voltage source outputs the foregoing voltage waveform shown in FIG. 4 and it is assumed that T3 (pulse width)=1 msec, T4 (pulse interval)=2 msec, and the voltage peak value is set to 14 V. The control region 14 controls the voltage waveform and ON/OFF of the output. The voltage waveform generated from the activation voltage source is inputted to the line selection region and is then applied to the selected line.

The line selection region will now be described. The line selection region is comprised of switches such as relay switches and analog switches. When the electron source substrate has a matrix form of (m×n), m switches of sw1 to swm (not shown) are arranged in parallel and are connected to the X wiring terminals Dx1 to Dxm of the electron source substrate through Sx1 to Sxm. The switches sw1 to swm are controlled by the control region to operate so as to supply the voltage waveform from the activation voltage source to the line to be activated. For example, when a first line is activated, the switch sw1 is operated to select the first line and other lines are connected to the ground.

Timing for switching the line will now be explained regarding the case where a pulse for activation is sequentially supplied to each line as an example with reference to FIG. 3.

Figure 3:
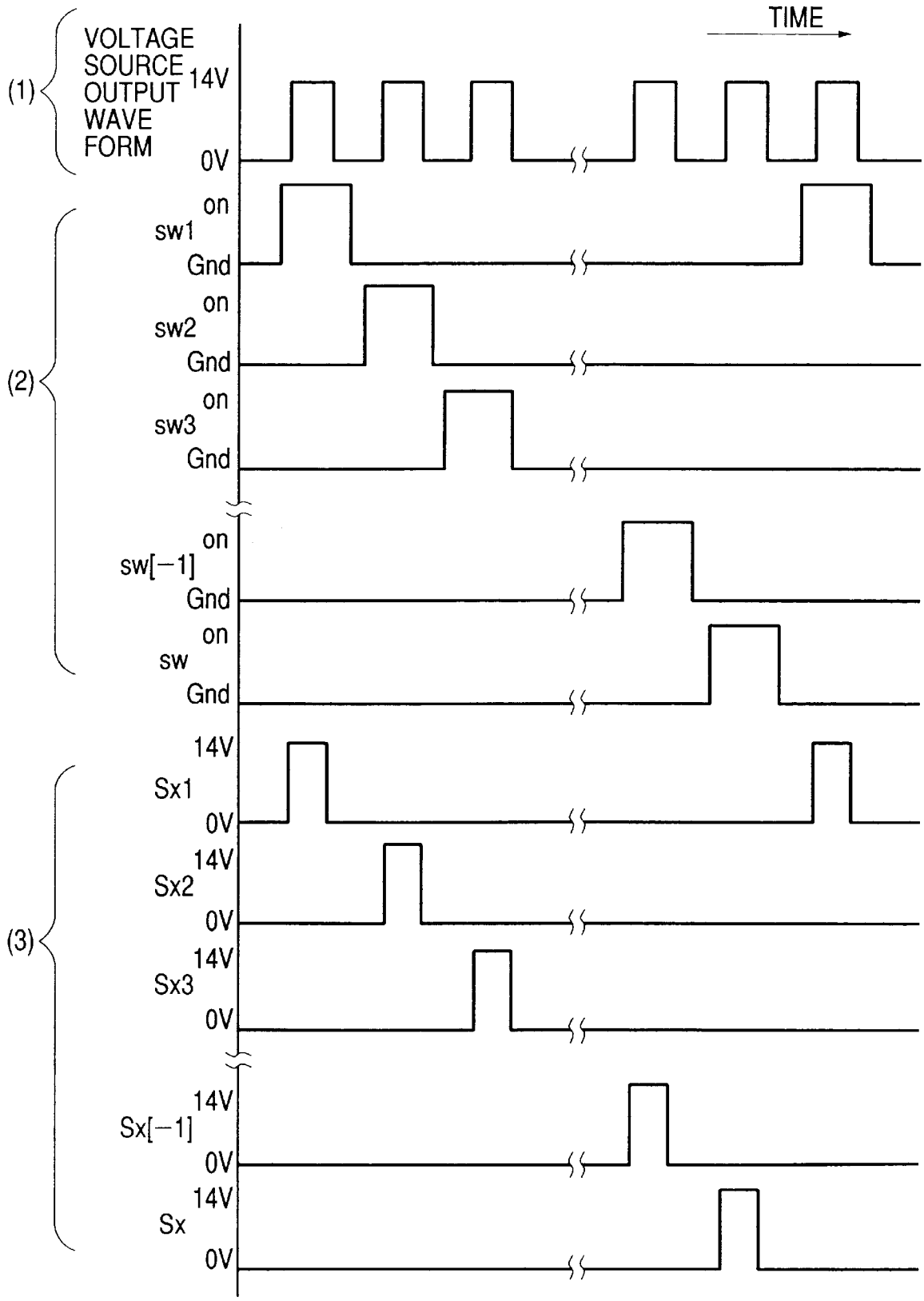
FIG. 3 is a chart for explaining line switching timing according to the present invention.

FIG. 3 is a timing chart showing operation timing of the activation voltage source and one of the line selection region shown in FIG. 2. Referring to FIG. 3, the uppermost graph denotes output waveforms of the activation voltage source, graphs of sw1 to swm show operation timings of the switches built in the line selection region, and graphs of Sx1 to Sxm indicate output waveforms of the line selection region.

As shown in FIG. 3, the activation voltage source outputs continuous rectangular pulses. When the pulse output is started, the switch sw1 is first tuned on to generate a pulse waveform to the terminal Dx1 of the electron source substrate. However, the switch sw1 is turned on for a period of time corresponding to only one pulse. The switch sw1 is turned off soon and, just after that, the switch sw2 is turned on. In this manner, the switches sw1 to sw1 are sequentially switched in response to the pulse output. After the output pulses shown by Sx1 to SxI are supplied to the lines 1 to DxI, the switching is sequentially repeated again from sw1. In this instance, when the number of groups of one block, namely, the number of rows of the X-directional wirings is equal to 10 lines (I=10), a rectangular wave having a pulse width of 1 msec is applied to each line at intervals of 20 msec.

As mentioned above, the activation operating apparatus used in the present invention is constructed so that the line switching can be smoothly performed.

The activation operating method for the multi-electron source of the present invention will now be described with reference to FIGS. 1A and 1B. In this case, in regard of the voltage waveform generated from the activation voltage source, it is assumed that T3 (pulse width)=1 msec, T4 (pulse interval)=2 msec, and the voltage peak value is set to 14 V.

In the present embodiment, for convenience in the description, it is considered that the number of rows of the X-directional wirings on the electron source substrate is set to 50, the electron-emitting devices arranged in one row as a line are set to one group, five lines, namely, five groups are set to one block. Accordingly, the whole of the electron source substrate is divided into ten blocks each comprising five lines. Specifically, five lines from X1 are allocated to a first block, five lines from X6 to the tenth line are allocated to a second block, and five lines from X46 to the 50th line are set to a tenth block as a final block. For the activation operation, a total activation time of one block is set to 60 minutes, the total time is divided into 12 steps each corresponding to five minutes, and the activation time is started from a first step and a twelfth activation step is set to a final activation step.

First, the first activation step operation for the first block divided as mentioned above is performed. Specifically, the pulse voltage for activation is sequentially applied to the electron-emitting devices arranged in the lines from X1 to X5 by using the foregoing line selecting method. After completion of the application to X5, the pulse voltage is repetitively applied again to X1 to X5 to progress the activation operation for the first block. The voltage having a rectangular waveform in which the pulse width is equal to 1 msec is applied to each line during the activation at intervals of 10 msec.

After the operation is executed for five minutes, the first activation step operation for the first block is terminated. Subsequently, the second block is selected by the control region and line selection region. The voltage pulse for activation is sequentially supplied repetitively to the lines from X6 to X10 for five minutes to perform the first activation step operation for the second block. The above operation is repeated to execute the first activation step operation up to the tenth block, so that the first activation step operation is performed to the whole electron-emitting devices on the electron source substrate.

Subsequently, the first block is selected again, the pulse voltage for activation is repetitively applied to the lines from X1 to X5 for five minutes in a manner similar to the above, thereby performing the second activation step operation for the first block. Similarly, the second activation step operation is sequentially performed to the second to tenth blocks, so that the second activation step operation for the whole electron-emitting device is terminated.

The above method is repeated to allow the whole blocks to be subjected to the operation up to the twelfth activation step operation as a final activation step, so that the activation procedure for the whole electron-emitting devices on the electron source substrate can be completed. In the present embodiment, since each activation step requires five minutes, the total number of steps is twelve, and ten blocks exist, the activation of the whole electron-emitting devices requires 600 minutes. Even when the activation operation is sequentially performed up to the 10 blocks, it requires 600 minutes as well as the method of the present invention.

As mentioned above, according to the present invention, the electron-emitting devices on the electron source substrate are divided into a plurality of blocks, the activation operation is also divided into a plurality of steps, and the activation step operation is performed to each block step by step. Consequently, even when the gas atmosphere in the image-forming apparatus is changed in association with the elapse of the activation time, the whole blocks are equally influenced. Therefore, a large difference between the electron-emitting device properties of the block activated initially in the activation procedure and those of the block activated finally can be suppressed, so that the image-forming apparatus with good uniformity can be manufactured.

In this case, as for the activation step, the operation is divided on the basis of the voltage application time to determine the steps of the first to final activation steps. In addition, the activation operation is divided into steps on the basis of the value of the current If which flows through the electron-emitting devices and the activation operation can be also performed. Specifically, there can also be used a method of shifting the activation operation to the next block on the basis of a current value detected by the ammeter shown in FIG. 2 when the current value reaches a desired value. Alternatively, the activation operation is divided into steps on the basis of the partial pressure of the activation gas in the image-forming apparatus and the activation operation can also be performed.

Specifically, there can be used a method in which after the activation gas is introduced into the image-forming apparatus, the activation procedure is executed while monitoring the partial pressure of the activation gas, and the activation operation is shifted to the next block in accordance with the fluctuation of the activation gas partial pressure at a time point when it reaches a predetermined partial pressure. In this case, since the fluctuation of the partial pressure at the initial activation procedure is frequently large, the initial activation step time is reduced in many cases.

Although the number of blocks, number of activation steps, number of lines, and duty ratio have been appropriately set and the example has been shown, they are not limited to them but desired values can be properly selected depending on the total number of lines of the electron source substrate and activation conditions.

A second embodiment will now be described hereinbelow.

In case of using the above method, in terms of the same electron-emitting device, the activation operation is divided into a plurality of steps and there is a period of time during which the activation operation is not performed between the plurality of steps. The electron-emitting device used in the present invention has properties referred to as postpause excess current properties which will be described hereinbelow.

The properties are as follows. In the case where the present electron-emitting device is left for a long time in the atmosphere of the activation gas without being subjected to the activation operation, namely, without application of the pulse voltage for activation, the pulse voltage for activation is applied to it, a large device current flows at the most initial stage in some cases as compared with the case where the pulse voltage for activation, being equivalent to the above voltage, is repetitively applied steadily. When such a phenomenon called postpause excess current properties occurs, the device current is temporarily reduced owing to the device current which excessively flows, or even if the activation operation is continuously performed, the electron-emitting properties after completion of the activation operation are deteriorated in some cases. Consequently, such an activation defect problem that the activation time is extended or fine electron-emitting properties are not obtained is caused in some instances.

In regard of the above problem, the influences vary depending on the kind or pressure of the activation gas surrounding the electron-emitting device and period of time during which the device is left in the atmosphere.

When the kind or pressure of the activation gas is changed between the steps, a phenomenon similar to that called the postpause excess current properties is confirmed in some cases.

When such a phenomenon occurs, in some instances, there is such a fear that the uniformity of the properties of the electron-emitting device in the electron source is deteriorated or the activation time is extended to cause such a problem that the manufacturing costs of the image-forming apparatus increase.

As mentioned above, in the activation procedure, the voltage pulse is repetitively applied from the activation voltage source to the electron source substrate in the atmosphere containing the gas made of the organic material through the X-direction wirings and Y-directional wirings to perform the activation operation. In case of the multi-type electron source (multi-electron source) in which a plurality of devices are arranged, the activation time for the whole electron source is extremely extended in the normal activation operating method as mentioned above. Consequently, the properties of the electron-emitting device activated initially are different from those of the electron-emitting device activated finally, so that such an adverse effect that the uniformity is deteriorated occurs.

Therefore, the electron-emitting devices in the electron source substrate are divided into a plurality of blocks as shown in, for example, FIGS. 1A and 1B, the activation operation are time-divisionally divided into a plurality of steps of, e.g., first to tenth steps, the first activation step operation is sequentially performed to each block, and after that, the second activation step operation is sequentially performed to each block. The procedure is sequentially performed to each block up to the tenth activation step operation by repeating the above operation, so that the activation procedure is terminated.

FIG. 1A shows the schematic diagram of the electron source substrate in which the electron-emitting devices arranged on the same X-directional wiring in the electron source substrate are set to one group, the electron-emitting devices arranged in a plurality of groups consist of one block, and the electron source substrate is divided into 24 blocks. Referring to FIG. 1B, the axis of abscissa denotes the activation voltage application time when the activation operation is performed to each block and the axis of ordinate denotes the current If which flows through the electron-emitting device of a certain block to schematically show the If profile upon activation. In this instance, as shown by the axis of abscissa of FIG. 1B, it is understood that the activation operation is divided into a plurality of steps of the first activation step, second activation step, . . . , and the final activation step every predetermined time.

When attention is paid to the same electron-emitting device, for example, the electron-emitting device in the first block upon activation operation in accordance with the passage of time, the first activation step operation is executed. Since the activation operation is shifted to the second block and the first activation step operation is executed up to the 24th block, the first block is left in the activation gas atmosphere in a state where the pulse voltage for activation is not applied.

When the second activation step operation for the first block is started, the postpause excess current properties appear. Consequently, under the same activation pulse voltage waveform conditions as those in the first activation step operation, an excess current initially flows, so that the activation defect may be caused. As mentioned as characteristics of the present invention, under waveform conditions different from the foregoing conditions, whereby the activation defect is not generated even when the device current flows, the pulse voltage for activation is applied at the beginning of the activation to continue the activation.

Specifically, the peak value of the pulse is set so as to be smaller than the voltage pulse finally supplied in the preceding activation step operation to reduce the value of the current which excessively flows due to the influence by the postpause excess current properties, so that the activation defect can be suppressed. When the peak value is remarkably small, the voltage control type negative resistant properties are generated and the excess current flows in some cases. Therefore, the peak value is preferably set to ½ or more of the voltage pulse peak value finally applied in the preceding activation step operation.

Reducing the pulse width as waveform conditions for the pulse voltage enables the activation defect to be suppressed. In addition, changing the waveform itself of the pulse voltage also can suppress the activation defect in certain cases. As an example, the activation defect can be suppressed by changing the pulse waveform from a rectangular waveform to a triangle waveform.

In these cases, the present inventors consider that an energy per unit time due to the activation pulse voltage applied to the electron-emitting device is suppressed to a low value at the beginning of the activation to enable partial destruction of the electron-emitting device to be suppressed, so that the activation defect can be prevented.

Subsequently, when the influence by the postpause excess current properties is reduced and the activation defect is avoided, the conditions are returned to the waveform conditions of the pulse voltage applied finally in the preceding activation step operation and the second activation step operation is continued. When the activation operation for the first block is advanced to the desired state in the second activation step operation, the second activation step operation for the first block is finished.

Similarly, until the second activation step operation from the second block to the tenth block is completed, the first block is left in the activation gas atmosphere in a state where the pulse voltage for activation is not applied.

At the start of the third activation step operation for the first block, the waveform conditions of the pulse voltage for activation are appropriately changed as well as the start of the second activation step operation, so that the activation can be continued while suppressing the activation defect.

Repeating the above process enables the procedure from the first activation step operation to the final 24th activation step operation to be performed without causing the activation defect in the whole of the first to tenth blocks, so that the activation procedure of the whole electron source can be safely finished.

That is, according to the present invention, even when the activation operation is divided into a plurality of steps, the activation procedure can be finished without generating the activation defect, so that the extension of the activation operation time or the occurrence of variation in electron-emitting properties can be suppressed.

FIG. 2 shows one example of the block diagram showing the construction of the multi-electron source activation apparatus of the present invention. The activation voltage source 11 generates an activation voltage pulse. The line selection region 12 supplies the voltage pulse generated by the activation voltage source to a necessary line. The ammeter 13 monitors the total current value of the device current flowing through the electron-emitting devices arranged in each line. The control region 14 controls the activation voltage source 11 and the line selection region 12 on the basis of the device current value per line detected by the ammeter 13 or a period of time during which the voltage is applied to each line. A plurality of electron-emitting devices to which the foregoing forming operation has been performed are arranged in a simple matrix form of (m rows×n columns) on the electron source substrate 10. The electron source substrate 10 is disposed in a vacuum apparatus (not shown) in an atmosphere containing a gas made of the organic material. The X-directional wirings Dx1 to Dxm of the electron source substrate are connected to Sx1 to Sxm of the activation operation apparatus. In this example, a group of a plurality of electron-emitting devices arranged in one line, namely, the device group of one line is set to one group. In this case, although one line in the row direction is defined as a block, one line in the column direction can be set as a block or a large number of lines can be considered as one block.

A method of executing a plurality of activation step operations while avoiding the influence by the postpause excess current properties will now be described in detail hereinbelow with reference to FIGS. 1A, 1B, 2, and 23.

Figure 23:
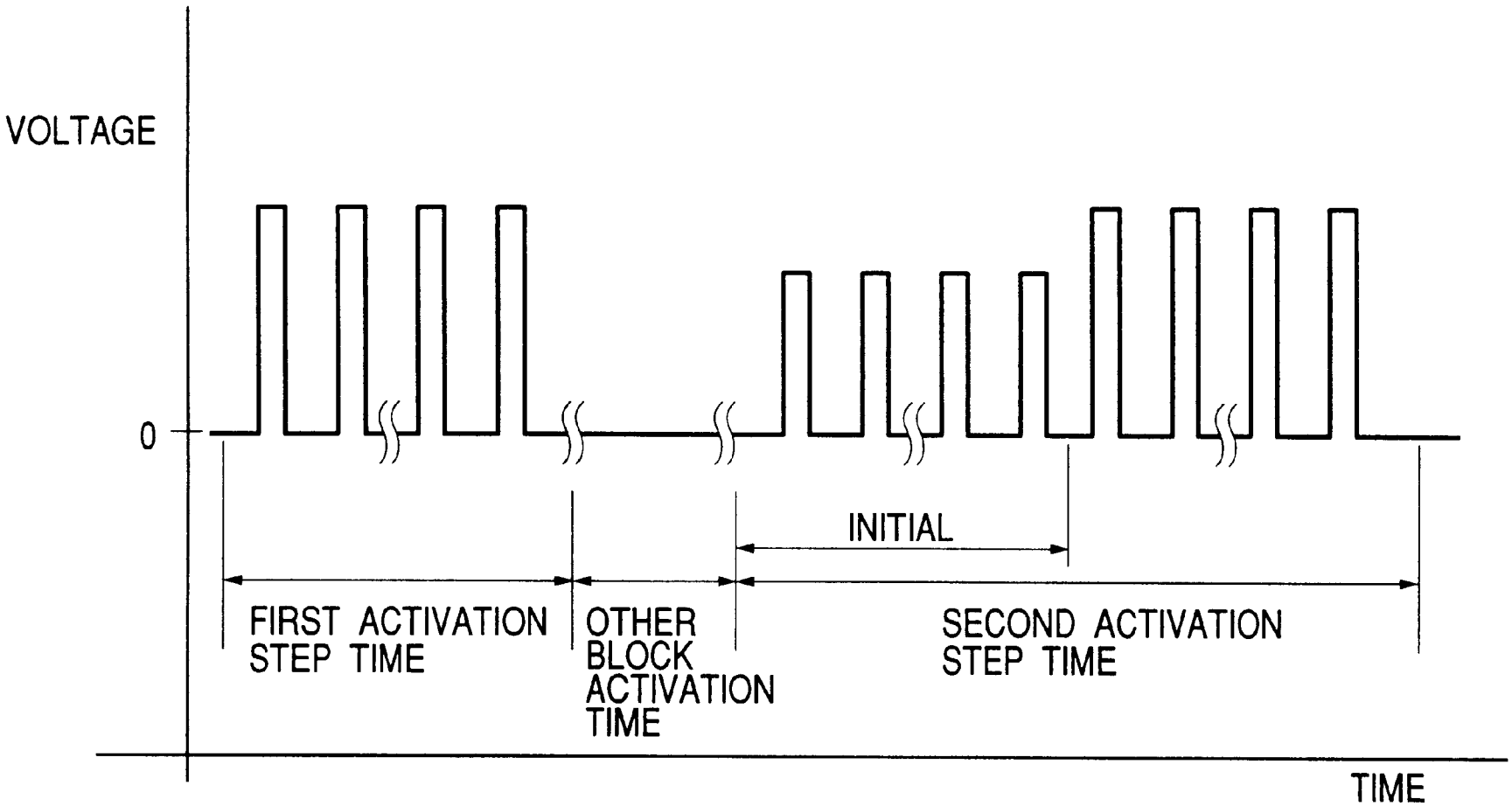
FIG. 23 is a schematic graph showing an example of a pulse voltage waveform of an activation operation in a second embodiment of the present invention.

FIG. 23 shows an example of a waveform of the activation pulse voltage to be applied to the electron-emitting devices in a specific block. The axis of abscissa denotes time and the axis of ordinate indicates an applied voltage value.

The activation voltage source 11 generates a voltage pulse necessary for activation. In the present embodiment, for example, the activation voltage source outputs the foregoing voltage waveform shown in FIG. 4. It is assumed that T3 (pulse width)=1 msec, T4 (pulse interval)=10 msec, and the voltage peak value is set to 14 V. The control region 14 controls the voltage waveform and ON/OFF of the output. The voltage waveform generated from the activation voltage source is inputted to the line selection region and is then applied to the selected line.

The line selection region will now be described. The line selection region is comprised of switches such as relay switches and analog switches. When the electron source substrate has a matrix form of (m×n), m switches of sw1 to swm (not shown) are arranged in parallel and are connected to the X wiring terminals Dx1 to Dxm on the electron source substrate through Sx1 to Sxm. The switches sw1 to swm are controlled by the control region to operate so as to supply the voltage waveform from the activation voltage source to the line to be activated. For example, when the first line is activated, the switch sw1 is operated to select the first line and other lines are connected to the ground.

Subsequently, a method for sequentially applying the activation pulse every line, namely, every block to execute the first to tenth activation step operations will now be described.

First, the first line is selected as a first block by the line selection region 12. Consequently, applying the pulse voltage generated from the activation voltage source is started to begin the first activation step operation for the first block (first activation step time in FIGS. 1A and 1B). An increase of the device current If which flows through the electron-emitting device of the first line in association with the progress of the activation operation can be detected by the ammeter 13 through the control region 14 in FIG. 3.

When the activation operation is advanced to a predetermined stage, the first activation step operation for the first block is terminated, namely, the selection of the first line is separated by the line selection region 12 and the second block, namely, the second line is subsequently selected by the line selection region 12 to start the first activation step operation for the second block. At that time, the progress of the activation of the second block can be monitored by the ammeter through the control region. The line selection region is controlled at a predetermined stage to finish the operation for the second block and the process is shifted to the operation for the third block. The procedure is repeated up to the final block, namely, final line (other block activation time in FIG. 23).

At a time point when the first activation step operation to the final block is completed, the procedure is returned to the first block to perform the second activation step operation. In this instance, the control region 14 changes the output waveform conditions of the activation voltage source. In the present embodiment, as shown at the beginning of the second activation step time in FIG. 23, the voltage peak value is reduced to 10 V and other conditions are the same as those of the first activation step operation.

After the waveform conditions are changed, the first line, namely, the first block is selected by the line selection region 12 and the pulse voltage is applied to the first block. When the device current value is monitored by the ammeter at that time, such a phenomenon that a large current flows at the most initial stage at which applying the pulse voltage is started and, after that, the current value is deteriorated and stabilized to a predetermined value is shown. The occurrence of the postpause excess current properties is confirmed.

Since the pulse waveform value is previously lowered to 10 V, the excess current value can be also suppressed so as to be smaller than that of the current which flowed at the final stage of the first activation step operation. When the pulse peak value of the activation voltage source is again returned to 14 V after the device current value is stabilized, the current having substantially the same value as that of the device current which flowed at the final stage of the first activation step operation flows, so that it is shown that the activation defect can be avoided. Subsequently, the activation pulse voltage having a peak value of 14 V is repetitively applied to perform the second activation step operation for the first block. When the operation is advanced to a predetermined stage, the second activation step operation is terminated (second activation step time in FIG. 23).

The activation operation is executed to the whole blocks while the above method is applied at the initial stage of the activation step operation of each block, so that the activation process is completed.

As mentioned above, the initial pulse waveform conditions at the time when the activation operation is again started are changed, the device current If which flows through the electron-emitting device when the pulse is supplied is monitored, and after the current value is stabilized, the conditions are again returned to the pulse waveform conditions of the pulse supplied at the final stage of the preceding step, so that the influence by the postpause excess current properties is avoided and the occurrence of the activation defect can be suppressed.

The case where the peak value of the pulse was changed has been shown in the above-mentioned example. Changing the width, interval, and waveform itself of the pulse to be supplied also enables the influence by the postpause excess current properties to be avoided. Desired values of the conditions can be properly selected depending on the total number of lines of the electron source substrate or activation conditions.

In the above-mentioned example, the case where the peak value was set to a predetermined value, namely, 14 V in the activation operation other than the initial stage of the activation step operation has been shown. The value is not limited to it but the activation operation may be performed by gradually changing the waveform conditions such as peak value and the like even in the same activation step operation.

The above embodiment shows the avoiding example in the case where in the same activation gas atmosphere, the application of the activation pulse voltage is interrupted and the activation defect is generated. The invention is not limited to it. For example, even in the case where the kind of activation gas is changed or the gas partial pressure is changed during the activation procedure, or the activation procedure is interrupted due to an unexpected accident and the activation operation is again performed, the present invention can be applied. It is effectively operated even in the case.

Although the activation operating method of the multi-electron source as characteristics of the present invention has been described as mentioned above, the electron-emitting devices arranged in the multi-electron source can be operated by a method which will be described hereinbelow.

Image-forming Apparatus

Figure 15:
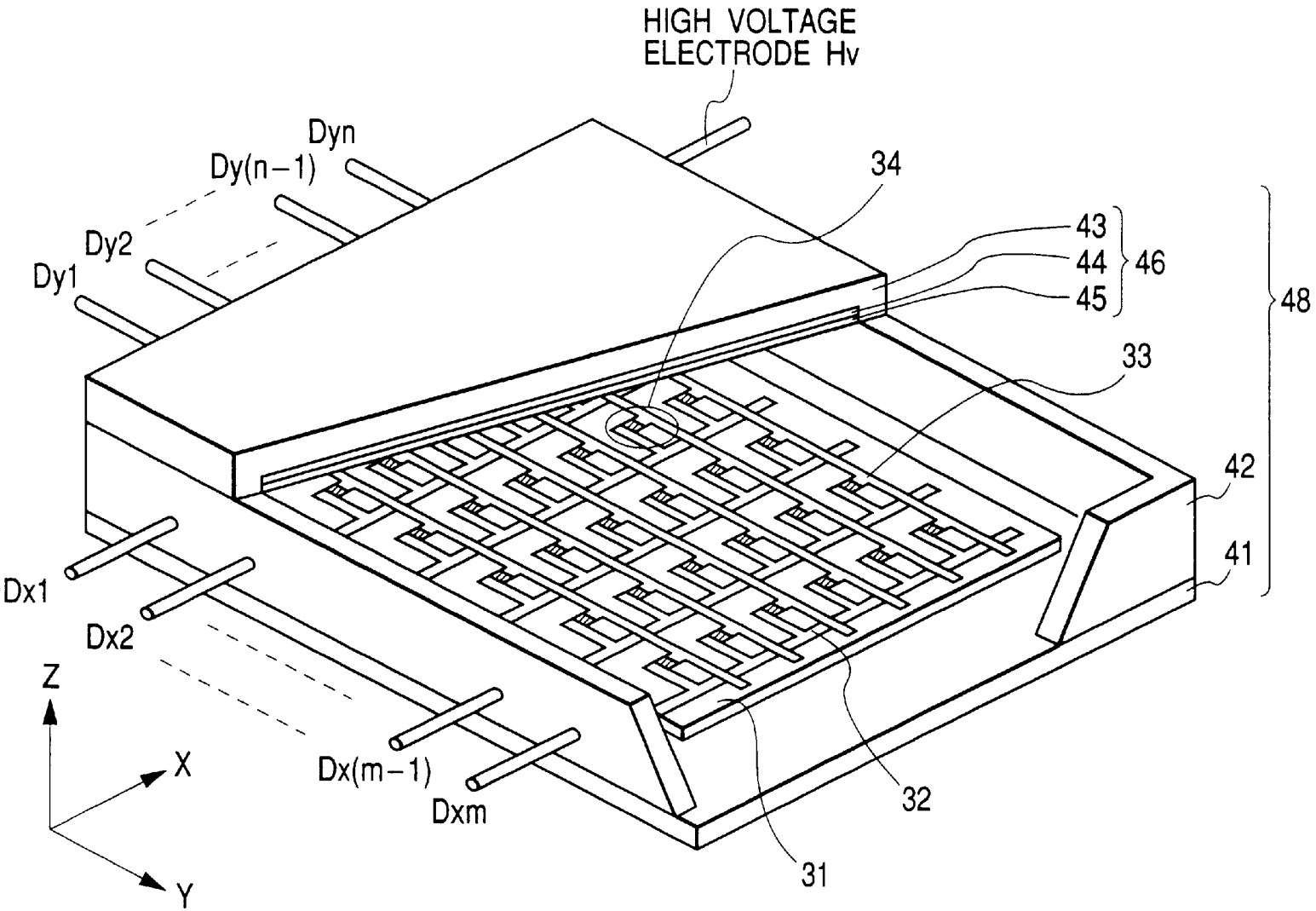
FIG. 15 is a schematic view showing an example of a display panel of an image-forming apparatus using the electron source to which the present invention is applied.

An image-forming apparatus having the above-mentioned electron source as a display panel will now be explained. FIG. 15 is a schematic view showing an example of a display panel of an image-forming apparatus using the electron source to which the present invention is applied.

Referring to FIG. 15, a plurality of electron-emitting devices are arranged on an electron source substrate 31. The electron source substrate 31 is fixed to a rear plate 41. A face plate 46 is constructed in such a manner that phosphor 44 and metal back 45 are formed on the internal surface of a glass substrate 43. The rear plate 41 and face plate 46 are connected to a supporting frame 42 by using frit glass or the like. An envelope 47 serving as a vacuum container (container) to keep the electron source in a vacuum state is airtightly constructed by sintering at a temperature of 400 to 500° C. for ten minutes or more in air of a nitrogen atmosphere.

Each electron-emitting region 34 corresponds to the electron-emitting region 5 in FIGS. 6A and 6B. Each of X-direction wirings 32 and each of Y-direction wirings 34 are connected to a pair of device electrodes of each electron-emitting device. Scan signal supplying means (not shown) for supplying a scan signal to select a row of the electron-emitting devices 34 arranged in the X direction is connected to each X-directional wiring 32. Modulation signal generating means (not shown) for modulating each column of the electron-emitting devices 34 arranged in the Y direction in accordance with an input signal is connected to each Y-directional wiring 33. A driving voltage to be applied to each electron-emitting device is supplied as a differential voltage between the scan signal and the modulation signal which are supplied to the device.

The envelope 47 is constituted of the face plate 46, supporting frame 42, and rear plate 41 as mentioned above. The rear plate 41 is provided mainly in order to strengthen the intensity of the substrate 31. In the case where the substrate 31 itself has an enough intensity, therefore, the rear plate 41 as a separate member can be unneeded. That is, the supporting frame 42 is directly seal-connected to the substrate 31 and the envelope 47 can be constructed by the face plate 46, supporting frame 42, and substrate 31. On the other hand, the envelope 47 having an enough intensity for the atmosphere pressure can be also constructed by arranging supporting members (not shown) called spacers between the face plate 46 and the rear plate 41.

In the above construction, a simple matrix wiring is used, the device is individually selected, and it can be independently driven.

Figure 16A:
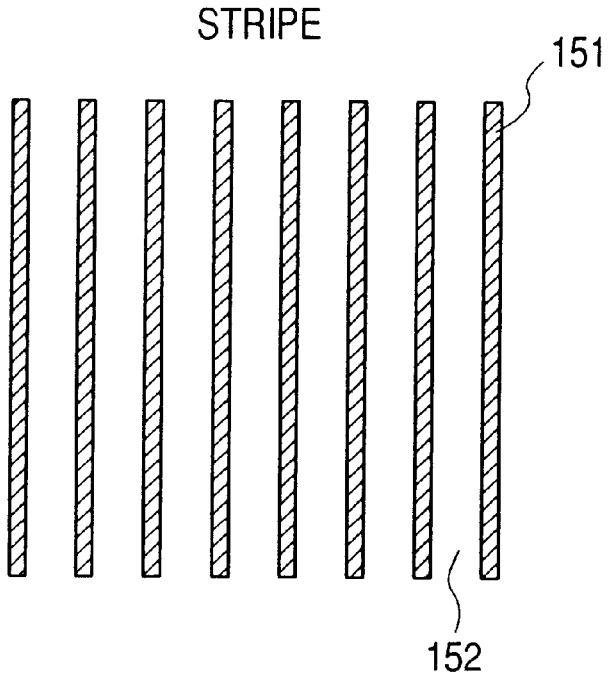
FIGS. 16A and 16B are schematic diagrams of fluorescent films used in the image-forming apparatus of FIG. 15.
Figure 16B:
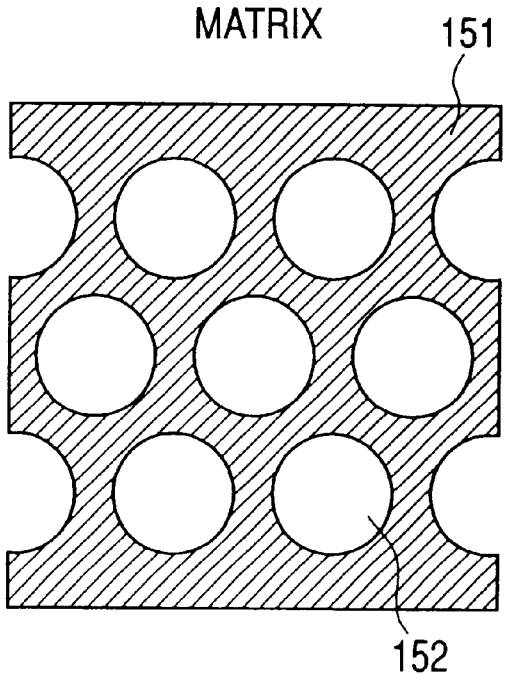

FIGS. 16A and 16B are schematic views of a fluorescent film to be used in the image-forming apparatus in FIG. 15. The fluorescent film 44 in FIG. 15 can be composed of phosphor alone in case of monochrome. In case of a color fluorescent film, the film can be composed of a black electroconductive material 151, called a black stripe or black matrix on the basis of the arrangement of phosphor, and phosphor 152. The object of providing the black stripe or black matrix is as follows. In case of color display, an application separation region among the phosphors 152 of necessary three primary color phosphors are blackened in order to cover color mixture and to suppress the degradation of display contrast caused of reflection of external light in the fluorescent film 44. The black stripe is composed of a material mainly containing graphite which is generally used. In addition, there can be used a material which has electroconductive properties and in which light is hardly transmitted or reflected.

As a method for applying the phosphor to the glass substrate 43, a precipitating method or printing method can be used irrespective of monochrome or color. Generally, the metal back 45 is formed on the internal side of the fluorescent film 44. The object of providing the metal back is to improve the luminance by mirror-reflecting a part of light of the emission light of the phosphor, directed to the internal surface, to the face plate 46 side, to use the metal back as an electrode to apply an electron beam accelerating voltage, and to protect the phosphor from damage because of collision between negative ions generated in the envelope. The metal back can be formed in such a manner that after the fluorescent film is formed, a smoothing operation (generally called "filming") for the surface on the internal surface side of the fluorescent film is performed and, after that, Al is deposited by using the vapor evaporation.

Further, in order to raise the electroconductive properties of the fluorescent film 44, a transparent electrode (not shown) can be provided on the external surface side of the fluorescent film 44 in the face plate 46.

When the foregoing seal-connection is performed, in case of the color display, it is necessary to make the phosphors of respective colors correspond to the electron-emitting devices, so that sufficient alignment is indispensable to the seal-connection.

The image-forming apparatus shown in FIG. 15 is manufactured, for example, as follows.

The envelope 47 is properly heated. While being held at a temperature of 80 to 250° C., the envelope is exhausted by an exhaust apparatus such as ion pump or absorption pump without using oil through an exhaust pipe (not shown) to set an atmosphere containing an enough small amount of organic material at a degree of vacuum of about $1\times10^{-7}$ Torr. After that, the exhaust pipe is heated to be melted by a burner, so that the envelope is sealed. In order to maintain a pressure in the envelope 47 after completion of the sealing, a getter operation can be also performed. It is such an operation that just before the sealing of the envelope 47 or after completion of the sealing, getter arranged in a predetermined position (not shown) in the envelope 47 is heated by a heating process using resistance heating or high-frequency heating to form a deposited film. Generally, the getter contains Ba. Owing to the adsorptive action of the deposited film, the atmosphere in the envelope 47 is kept. In this instance, the processes subsequent to the forming operation of the electron-emitting device can be properly set.

Subsequently, a constructional example of a driving circuit for performing a television display based on a television signal of the NTSC system to the display panel constructed by using the electron source with the simple matrix arrangement will now be described with reference to FIG. 17.

Figure 17:
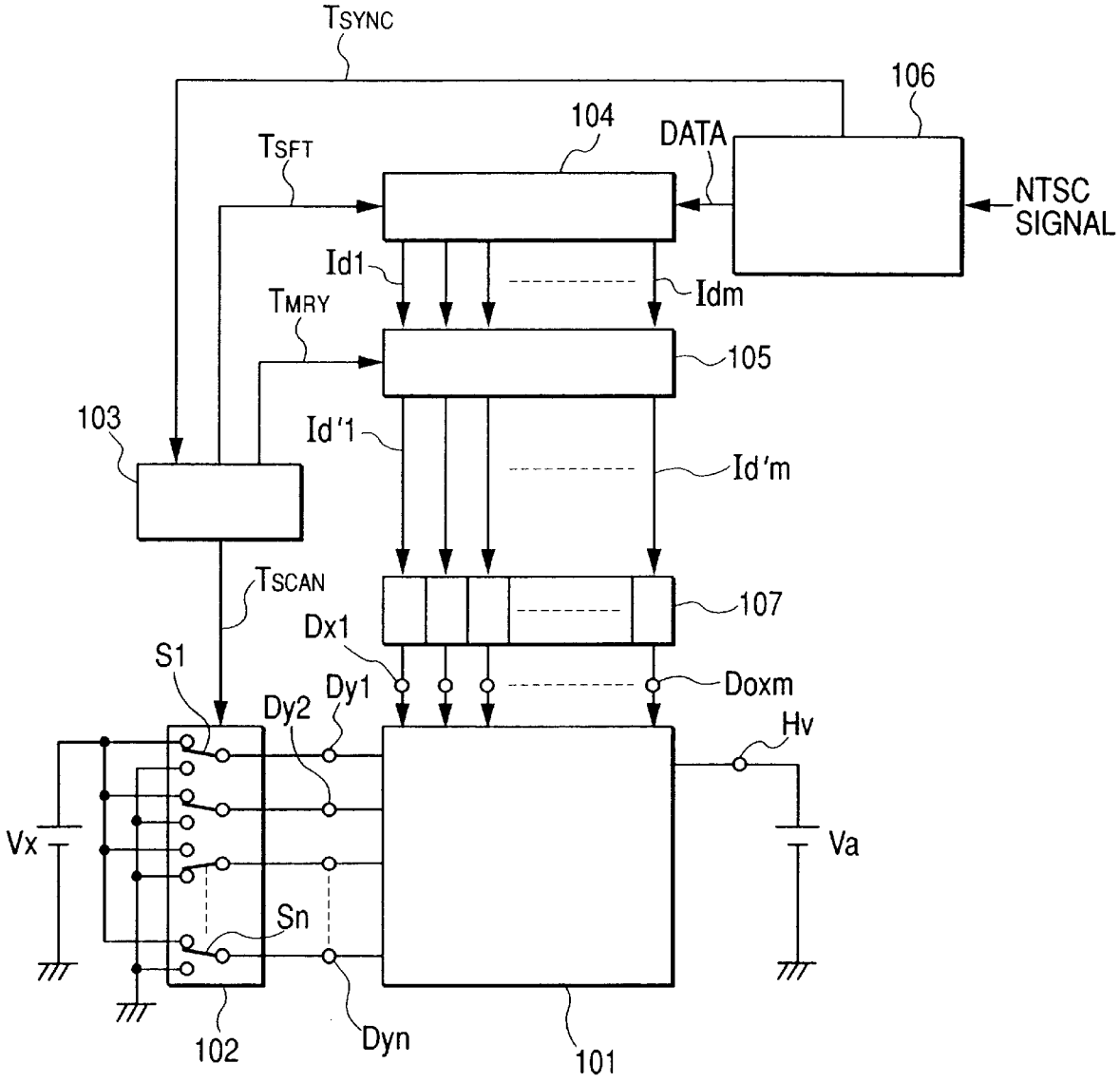
FIG. 17 is a-block diagram showing an example of an image-forming apparatus for displaying in accordance with a television signal of an NTSC system.

Referring to FIG. 17, reference numeral 101 denotes an image display panel; 102 a scanning circuit; 103 a control circuit; 104 a shift register; 105 a line memory; 106 a sync signal separating circuit; 107 a modulation signal generator; and Vx and Va DC voltage sources. The display panel 101 is connected to an external electric circuit through the terminals Dx1 to Dxm, terminals Dy1 to Dyn, and a high-voltage electrode Hv. A scan signal to drive the electron source provided in the display panel, namely, sequentially drive the electron-emitting device groups arranged in a matrix wiring form of (M rows×N columns) every row (M devices) is supplied to the terminals Dy1 to Dyn.

A modulation signal to control an output electron beam of each of the electron-emitting devices of one row selected by the above scan signal is supplied to the terminals Dx1 to Dxm. A DC voltage of, for example, 10 kV is applied to the high voltage electrode Hv by the DC voltage source Va. The DC voltage is an accelerating voltage to supply an energy enough to activate the phosphor to an electron beam emitted from the electron-emitting device.

The scanning circuit 102 will now be described. The circuit includes N switching devices therein (in the diagram, they are schematically shown by reference symbols S1 to Sn). Each switching device selects either one of an output voltage of the DC voltage source Vx or 0 V (ground level) and is electrically connected to one of the terminals Dy1 to Dyn of the display panel 101. Each of switching devices S1 to Sn is operated on the basis of a control signal Tscan outputted from the control circuit 103. The scanning circuit can be constructed by combining switching devices such as FETs.

In case of the present embodiment, on the basis of the properties of the electron-emitting device (electron-emitting threshold voltage), the DC voltage source Vx is set so as to generate such a constant voltage that a driving voltage to be applied to the device which is not scanned is equal to or less than the electron-emitting threshold voltage.

The control circuit 103 has a function to adjust the operations of respective sections so as to perform a proper display on the basis of an image signal inputted from the outside. The control circuit 103 generates control signals Tscan, Tsft, and Tmry to respective sections on the basis of the sync signal Tsync transmitted from the sync signal separating circuit 106.

The sync signal separating circuit 106 is a circuit to separate a sync signal component and a luminance signal component from the television signal of the NTSC system inputted from the outside and can be constructed by using a general frequency separating (filter) circuit or the like. The sync signal separated by the sync signal separating circuit 106 is constituted of a vertical sync signal and a horizontal sync signal. In this case, it is shown as a Tsync signal in the diagram for convenience in the description. The luminance signal component for images separated from the television signal is shown as a DATA signal for convenience. The DATA signal is inputted to the shift register 104.

The shift register 104 serial/parallel converts the DATA signal which is serially inputted time-sequentially every line of the image and operates on the basis of the control signal Tsft which is transmitted from the control circuit 103 (that is, the control signal Tsft can be used as a shift clock of the shift register 104). Serial/parallel converted data as much as one line of the image (corresponding to driving data of M electron-emitting devices) is outputted as M parallel signals Id1 to Idm from the shift register 104.

The line memory 105 is a memory unit for storing data as much as one line of the image only for a necessary period of time and properly stores contents of Id1 to Idm in accordance with the control signal Tmry transmitted from the control circuit 103. The stored contents are generated as I'd1 to I'dm and inputted to the modulation signal generator 107.

The modulation signal generator 107 is a signal source to properly driving and modulating each of the electron-emitting devices in accordance with each of the image data I'd1 to I'dm. Its output signal is supplied to the electron-emitting devices in the display panel 101 through any one of the terminals Dx1 to Dxm. As mentioned above, the electron-emitting device to which the present invention is applicable has the following fundamental properties for the emission current Ie.

That is, the electron emission has a definite threshold voltage Vth. Only in the case where a voltage of Vth or more is applied, the electron emission occurs. For a voltage that is equal to the electron-emitting threshold value or more, the emission current is also changed in correspondence to a change in application voltage to the device. Therefore, in the case where a pulse-shaped voltage is applied to the present device, even if a voltage of, for example, the electron-emitting threshold value or less is applied, the electron emission is not caused. However, when a voltage of the electron-emitting threshold value or more is applied, the electron beam is generated. At that time, the intensity of the generated electron beam can be controlled by changing a pulse peak value Vm. The total amount of charges of the generated electron beam can be also controlled by changing a pulse width Pw.

Therefore, as a system for modulating the electron-emitting device in accordance with the input signal, a voltage modulating system and a pulse width modulating system can be applied. When the voltage modulating system is embodied, as a modulation signal generator 107, there can be used a circuit of the voltage modulating system to generate a voltage pulse having a predetermined length to properly modulate a peak value of the pulse in accordance with inputted data.

When the pulse width modulating system is embodied, as a modulation signal generator 107, there can be used a circuit of the pulse width modulating system to generate a voltage pulse having a constant peak value and properly modulate the width of the voltage pulse in accordance with inputted data.

For the shift register 104 and line memory 105, both of a digital signal type one and an analog signal type one can be used because it is sufficient that the serial/parallel conversion or storage of the image signal is performed at a predetermined speed.

In case of using the digital signal type, it is necessary to convert an output signal DATA of the sync signal separating circuit 106 into a digital signal. It is sufficient to provide an A/D converter for an output region of the sync signal separating circuit 106. In association with it, depending on the digital signal or analog signal as an output signal of the line memory 105, the design of the circuit used as a modulation signal generator 107 is slightly changed.

That is, in case of the voltage modulating system using a digital signal, for example, a D/A converting circuit is used as a modulation signal generator 107 and an amplifying circuit or the like is added as necessary. In case of the pulse width modulating system, as a modulation signal generator 107, a circuit constructed by combining a high-speed oscillator, a counter for counting wave numbers generated by the oscillator, and a comparator for comparing an output value of the counter with an output value of the memory. An amplifier for amplifying a voltage of the pulse width modulated modulation signal outputted from the comparator to a driving voltage of the electron-emitting device can be added as necessary.

In case of the voltage modulating system using an analog signal, an amplifying circuit using, for example, an operational amplifier or the like can be used as a modulation signal generator 107 and a level shifting circuit can be added as necessary. In case of the pulse width modulating system, for example, a voltage control type oscillating circuit (VOC) can be applied and an amplifier for amplifying a voltage to a driving voltage of the electron-emitting device can be also added as necessary.

In the image-forming apparatus of the present invention capable of having the above construction, the voltage is applied to each electron-emitting device through each of the container external terminals Dx1 to Dxm and Dy1 to Dym causes the electron emission. A high voltage is applied to the metal back 45 or transparent electrode (not shown) via the high voltage electrode Hv to accelerate the electron beam. The accelerated electrons hit the fluorescent film 44 to cause light emission, thereby forming an image.

Figure 18:
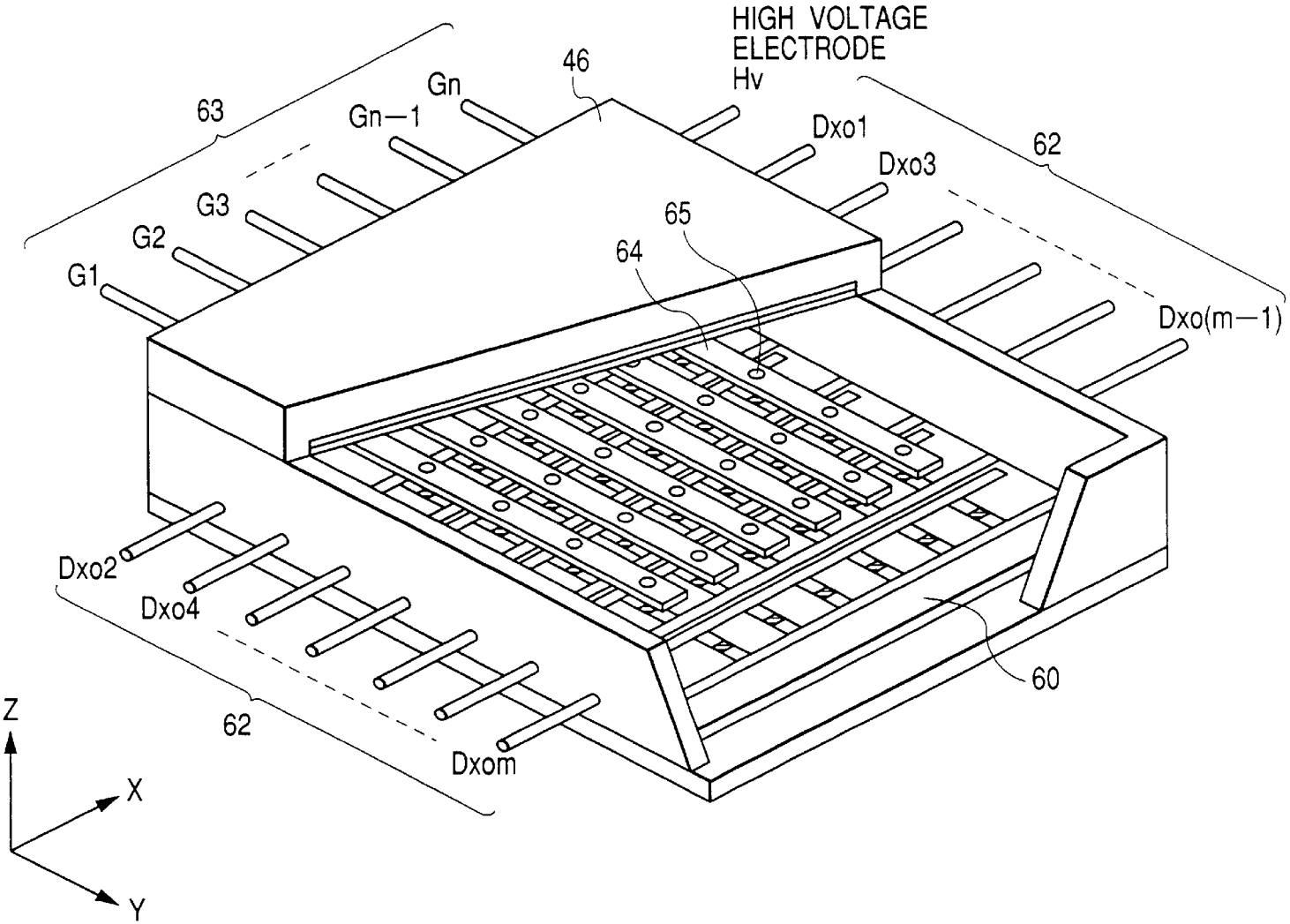
FIG. 18 is a schematic view showing an example of a display panel of an image-forming apparatus using an electron source to which the present invention is applied.
Figure 19:
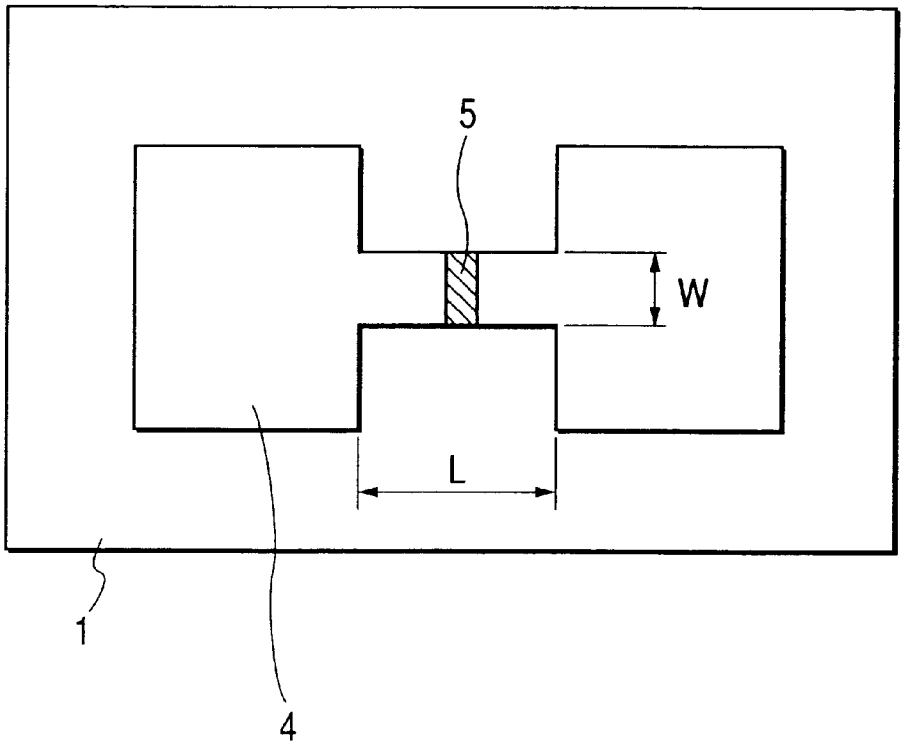
FIG. 19 is a schematic diagram showing an example of an electron-emitting device.
Figure 20:
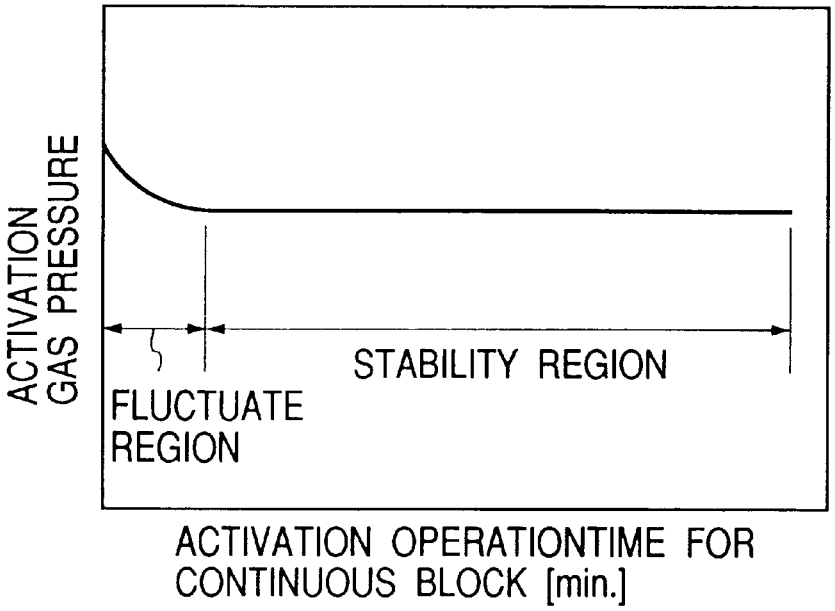
FIG. 20 is a schematic graph showing fluctuation of an activation gas pressure upon activation operation.

The construction of the image-forming apparatus mentioned in this case denotes an example of the image-forming apparatus to which the present invention can be applied and various modifications can be made on the basis of the spirit of the present invention. Although the input signal of the NTSC system has been mentioned, the input signal is not limited to it. An input signal of the PAL system, SECAM system, or other TV signal system (for example, a high quality TV system such as MUSE system) including a large number of scanning lines that is larger than that of the NTSC system can be also applied. Subsequently, an electron source with the ladder-like arrangement and an image-forming apparatus will now be described with reference to FIG. 18. FIG. 18 is a schematic diagram showing an example of the electron source with a ladder-like arrangement. In FIG. 18, the same parts as those shown in FIG. 15 mentioned above are designated by the same reference numerals as those in FIG. 15. A different portion between the structure of the image-forming apparatus shown in FIG. 18 and that of the image-forming apparatus with a simple matrix arrangement shown in FIG. 15 is whether grid electrodes 64 are provided between an electron source substrate 60 and the face plate 46 or not.

Referring to FIG. 18, reference numeral 64 denotes the grid electrode; 65 a hole through which the electron-emitting device passes; 62 a container external terminal constituted of Dx1, Dx2, . . . , Dxm; 63 a container external terminal constituted of G1, G2, . . . , Gn each of which is connected to the grid electrode 64; and 60 the electron source substrate in which a common wiring between the device rows is set to the same wiring.

The grid electrode 64 modulates the electron beam emitted from the electron-emitting device. In order to allow the electron beam to pass through each stripe-shaped electrode provided perpendicular to each device row with the ladder-like arrangement, circular openings 65 are formed so as to correspond to the respective devices in a one-to-one corresponding manner. The form and setting position of each grid are not limited to those shown in FIG. 18. For example, a large number of through holes can be formed as opening in a mesh-like form. The grid can be also provided around or near the electron-emitting device.

The container external terminal 62 and grid container external terminal 63 are electrically connected to a control circuit (not shown).

In the image-forming apparatus of the present embodiment, the modulation signal as much as one line of the image is simultaneously supplied to each grid electrode column synchronously with sequential driving (scanning) the device row one line by one. Consequently, the irradiation of each electron beam to the phosphor is controlled, so that the image can be displayed one line by one.

The image-forming apparatus of the present invention can be also used as a display apparatus for television broadcasting, a display apparatus of a television conference system or a computer, or an image-forming apparatus serving as an optical printer constructed by using a photosensitive drum.

The present invention will now be described in detail with respect to specific examples. The present invention is not limited to the examples. The invention also includes examples in which displacements of respective constitutional elements and a change in design are made within a range where the object of the present invention is accomplished.

EXAMPLE 1

The present example denotes an example of the manufacturing method of the electron source substrate in which a large number of surface conduction electron-emitting devices are arranged in a simple matrix form (the number of devices: 240×480), mainly, the procedure for the activation operation for the electron source substrate.

The present example will now be specifically explained with reference to FIGS. 1A, 1B, and 3.

Referring to FIG. 2, the activation voltage source 11 generates an activation voltage pulse. The line selection region 12 applies the voltage pulse generated by the activation voltage source to a necessary line. The ammeter 13 monitors a total current value of the device currents flowing through the electron-emitting devices arranged in each line. The control region 14 controls the activation voltage source 11 and the line selection region 12 on the basis of the device current value of one line detected by the ammeter 13. A plurality of electron-emitting devices to be activated, to which the forming operation has already been performed, are arranged in a simple matrix form of (m rows×n columns) (in the present example, m=240 and n=480, so that 240 rows×480 columns) on the electron source substrate 10.

The electron source substrate 10 was disposed in a vacuum apparatus (not shown) in an atmosphere containing a gas made of the organic material. The X-directional wirings Dx1 to Dxm of the electron source substrate were connected to Sx1 to Sxm of the activation operation apparatus. In the present example, there was used an activation voltage source to generate an output in which the pulse width was set to 1 msec, pulse interval was set to 1.1 msec, and the voltage peak value was set to 14 V.

In this case, one line was set to one group and 10 lines, namely, 10 groups were set to one block. 240 lines as a whole were divided into 24 blocks. Specifically, the first to tenth lines of the X-directional wirings were set to a first block, the next 10 lines were set to a second block, the following lines were similarly set to blocks, and 10 lines of the 231st to 240th lines were set to a 24th block.

In the activation, a first activation step operation was sequentially performed to each block. The activation operating method in the first block, namely, in the lines Dx1 to Dx10 will now be described hereinbelow. In this case, it was assumed that the activation step operation was finished for a predetermined period of time. The period of time was determined to five minutes and the number of activation step operations was set to 12 steps, so that the activation operation was performed to each line for 60 minutes in total. In the present example, a voltage for activation having a waveform in which the pulse width=1 msec and the pulse interval=11 msec was applied to each line.

In order to first activate the electron-emitting devices of the lines Dx1 to Dx10, the control region controlled the line selection region, whereby 10 lines were sequentially switched and selected as shown in FIG. 3 (in the diagram, 1=10) and the voltage pulse was sequentially applied from the activation voltage source to each line. The device current If which flowed through the electron-emitting devices of the first line was monitored by the ammeter simultaneously with the pulse application, as shown in the first activation step portion in FIG. 1B, it was confirmed that the device current If of the first line was increased as much as 0.25A after five minutes from the start of the activation. At that time, the first activation step operation for the first block was finished and the procedure was shifted to the first activation step for the second block.

In a manner similar to the above method, in the first activation step for the second block as well, in order to first activate the electron-emitting devices of the lines Dx11 to Dx20, the control region controlled the line selection region, whereby 10 lines were sequentially switched and selected and the voltage pulse was sequentially supplied from the activation voltage source to each line. It was confirmed that a value of the device current If of each line of the second block also increased in a manner similar to the lines of the first block. After the voltage pulse for activation was supplied to the lines of the second block for five minutes, the first activation step operation for the second block was finished and the procedure was shifted to the first activation step for the third block.

The above first activation step operation for five minutes per block was sequentially executed up to the 24th block.

Subsequently, the first block was selected again and the second activation step operation was performed for five minutes in the same manner as the above method. After that, similarly, the second activation step operation was subsequently performed to the second to 24th blocks and the second activation step operation for all of the blocks was completed.

In a manner similar to the above, the third activation step operation to the twelfth activation step operation were executed to all of the blocks of the first block to the 24th blocks, so that the activation procedure of the electron-emitting device on the electron source substrate of the present example was finished.

When the device current If of each line at the end of the tenth activation step operation was checked, every line indicated substantially the same value. A difference between a mean value If of each line in the first block and a mean value If of each line in the 24th block was within 5%.

As for a period of time needed for the activation of the whole lines, it took (5 minutes×24 blocks×12 steps=) 1440 minutes (24 hours). The activation could be performed for the same period of time as that of the method in which the activation was completed every block of the first to tenth block and, after that, the operation was shifted to the activation for the next block. According to the example of the present invention, enough effects could be obtained without extending the activation operation time.

As a result of the activation as mentioned above, the emission current properties of the electron-emitting devices were remarkably uniformed, so that an image-forming apparatus (display apparatus) manufactured by using the electron source having a plurality of such electron-emitting devices produced high-quality images.

COMPARATIVE EXAMPLE 1

In a manner similar to the Example 1, the electron source substrate in which a plurality of electron-emitting devices to which the forming operation had already been performed were arranged in a simple matrix form of (240 rows×480 columns) was set as shown in FIGS. 1A and 1B and the activation was sequentially executed one block by one. At that time, a value of the device current flowing through the electron-emitting devices of each line was monitored. As for the If value of each line at the end of the activation operation, a difference between the value of the first block initially activated and that of the 24th block finally activated was 10% or more.

As mentioned above, as shown in the Example 1 and Comparative example 1, the devices were activated by using the activation apparatus of the present invention, so that the properties of the devices could be uniformed.

Although the electron source substrate in which a plurality of electron-emitting devices were arranged in a simple matrix form has been described in the present example, even when there was used a electron source substrate in which a plurality of electron-emitting devices are connected by a ladder-like wiring, the invention was similarly applicable. In this case, although one line was set to one group and the activation was executed on a row direction unit basis, the activation of the present invention could be also executed in such a manner that the group was formed on a column direction unit basis and the voltage was applied from the column-directional wiring.

EXAMPLE 2

A second example according to the present invention will now be described in detail hereinbelow.

There will be described an example in which the same activation apparatus in the present example as that of the Example 1 is used and an electron source substrate in which a plurality of electron-emitting devices to which the foregoing forming operation has already been performed are connected by a ladder-like wiring. It is shown in FIG. 13. In FIG. 13, the same constitutional components as shown in the diagram shown in the foregoing example 1 are designated by the same reference numerals and the explanations are omitted.

Referring to FIG. 13, 480 electron-emitting devices to be activated, to which the forming operation has already been performed, are arranged in 240 rows in a ladder-like form on an electron source substrate 110 (FIG. 13 shows only one part of five rows among 240 rows). The electron source substrate 110 is disposed in a vacuum apparatus (not shown) in an atmosphere containing a gas made of the organic material. The half of the ladder-like wirings of the electron source substrate are electrically connected to the line selection region through the ammeter 13 for monitoring the total current value of the device current flowing through the terminals D1 to Dm and the electron-emitting devices arranged in each line. The other half of wirings are connected to the ground level (0 volt). In the present example, it is assumed that the pulse width of an output of the activation voltage source is set to 1 msec, pulse interval is set to 1.1 msec, and the voltage peak value is set to 14 V.

In this case as well, in the same manner as that of the Example 1, one line was set to one group and 10 lines, namely, 10 groups were set to one block. The whole of 240 lines were divided into 24 blocks. Specifically, the first to tenth lines of the X-directional wirings were set to the first block, the next 10 lines were set to the second block, the following lines were similarly set, and the 231st to 240th lines were set to the 24th block.

In the activation, the first activation step operation was sequentially performed one block by one. The-activation operating method in the first block, namely, in the lines Dx1 to Dx10 will now be described hereinbelow. In this case, it was assumed that the activation step operation was finished for a predetermined period of time. The period was determined to five minutes and the number of activation step operations was set to 12 steps, so that the activation operation was performed to the lines for 60 minutes in total. In the present example, a voltage for activation having a waveform in which the pulse width=1 msec and the pulse interval=11 msec was applied to each line.

In order to first activate the electron-emitting devices of the lines Dx1 to Dx10, the control region controlled the line selection region, whereby 10 lines were sequentially switched and selected as shown in FIG. 3 and the voltage pulse was sequentially applied from the activation voltage source to each line. The device current If flowing through the electron-emitting devices of the first line was monitored by the ammeter simultaneously with the pulse application. As shown in the first activation step portion in FIG. 1B, it was confirmed that the device current If of the first line increased as much as 0.25A after five minutes from the start of the activation. At that time, the first activation step operation for the first block was finished and the operation was shifted to the first activation step for the second block.

In a manner similar to the above method, in the first activation step for the second block as well, in order to first activate the electron-emitting devices of the lines Dx11 to Dx20, the control region controlled the line selection region, whereby 10 lines were sequentially switched and selected and the voltage pulse was sequentially applied from the activation voltage source to each line. It was confirmed that a value of the device current If of each line of the second block also increased in a manner similar to the lines of the first block. After the voltage pulse for activation was applied to the lines of the second block for five minutes, the first activation step operation for the second block was terminated and the operation was shifted to the first activation step for the third block.

The above first activation step operation for five minutes per block was sequentially executed up to the 24th block.

Subsequently, the first block was selected again and the second activation step operation was performed for five minutes in the same manner as the above method. After that, similarly, the second activation step operation was subsequently performed to the second block to the 24th block and the second activation step operation for all of the blocks was completed.

In a manner similar to the above, the third activation step operation to the twelfth activation step operation were executed to all of the blocks of the first block to the 24th blocks, so that the activation procedure for the electron-emitting devices on the electron source substrate was finished.

When the device current If of each line at the time of the end of the tenth activation step operation was checked, every line indicated substantially the same value. A difference between the mean value If of each line in the first block and the mean value If of each line in the 24th block was within 5%.

As for a period of time needed for the activation for the whole lines, it took (5 minutes×24 blocks×12 steps=) 1440 minutes (24 hours). The activation could be performed for the same period of time as that of the method in which the activation was completed every block from the first block to the tenth block and, after that, the operation was shifted to the activation for the next block. According to the example of the present invention, enough effects could be obtained without extending the activation operation time.

As a result of the activation as mentioned above, the emission current properties of the electron-emitting devices were remarkably uniformed, so that the image-forming apparatus (display apparatus) manufactured by using the electron source having a plurality of such electron-emitting devices produced high-quality images.

EXAMPLE 3

A third example according to the present invention will now be described in detail hereinbelow.

In the present example, entirely the same activation apparatus and electron source substrate as those of the foregoing Example 1 were used and similarly connected. There was used an activation voltage source to generate an output in which the pulse width was set to 1 msec, pulse interval was set to 1.1 msec, and the voltage peak value was set to 14 V. In the present example, the group formation in the block was different from the foregoing examples.

Figure 22:
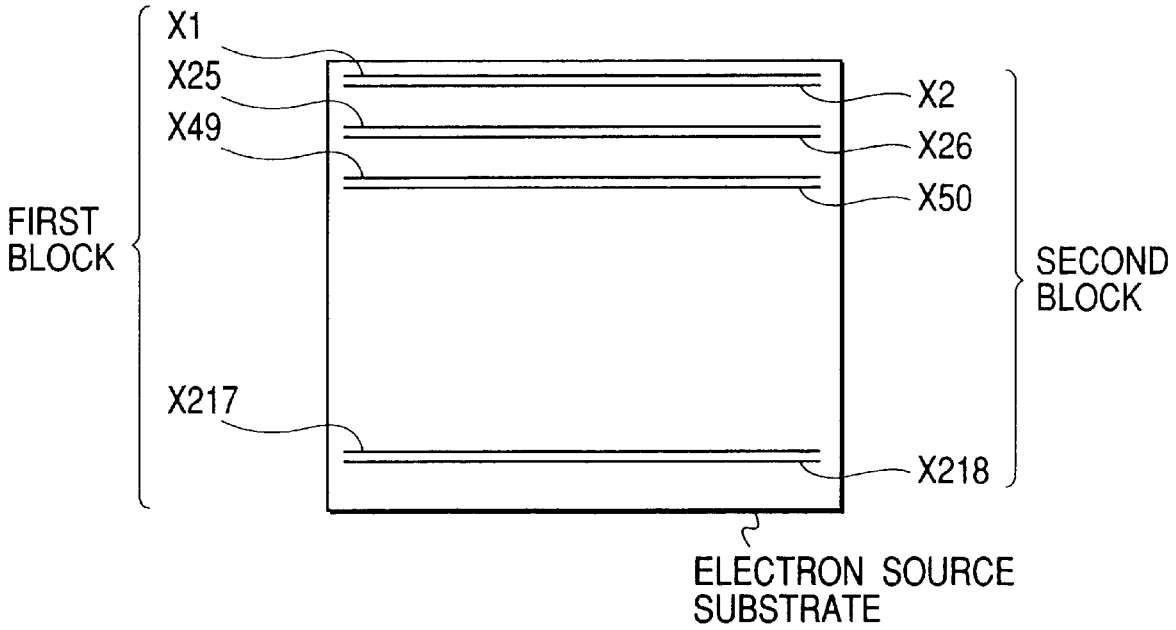
FIG. 22 is a diagram for explaining a block formation of an electron source substrate according to an embodiment of the present invention.

Specifically, as shown in FIG. 22, each of rows of the electron-emitting devices arranged in (240 rows×480 columns) on the electron source substrate was set to one group and 10 rows, namely, 10 groups were set to one block. At this time, a first block includes X1, X25, X49, . . . , and X217. In this manner, 10 lines (10 groups) were sequentially selected every 24 lines from X1 to form one block. Similarly, a second block was formed as a block by selecting X2, X26, X50, . . . , and X218. Third to 24th blocks were formed by repeating the selection. The 24th block had a group constituted of X24, X48, . . . , and X240.

In the activation process, the lines X1, X25, X49, . . . , and X217 of the first block were sequentially switched and selected and the voltage pulse for activation was repetitively applied for five minutes, thereby performing the first activation step operation. Subsequently, the first activation step operation was performed to the second block, third block, . . . , and 24th block in accordance with this order, so that the first activation step operation of the whole blocks was completed. Similarly, the activation operation was performed to the whole blocks by executing the activation operation from the second activation step up to the tenth activation step. The activation operation was completed.

In the present example, the activation operations for both of the adjacent lines were not simultaneously performed, so that a partial change in atmosphere upon activation in the image-forming apparatus could be suppressed and the influence could be reduced.

When the device current value If of each line at the end of the tenth activation step operation was checked, every lines indicated substantially the same value and a difference between an If mean value of each line of the first block and an If mean value of each line of the 24th block was not over 3%.

As for a period of time needed for the activation of the whole lines, it took (5 minutes×24 blocks×12 steps=) 1440 minutes (24 hours). The activation could be performed for the same period of time as that of the method in which the activation was completed every block from the first block to the tenth block and, after that, the operation was shifted to the activation for the next block. According to the example of the present invention, enough effects could be obtained without extending the activation operation time.

As a result of the activation as mentioned above, the emission current properties of the electron-emitting devices were remarkably uniformed, so that the image-forming apparatus (display apparatus) manufactured by using the electron source having a plurality of such electron-emitting devices produced high-quality images.

EXAMPLE 4

A fourth example according to the present invention will now be described in detail hereinbelow.

In the present example, entirely the same activation apparatus and electron source substrate as those of the foregoing Example 3 were used and similarly connected. There was used the activation voltage source to generate an output in which the pulse width was set to 1 msec, pulse interval was set to 1.1 msec, and the voltage peak value was set to 14 V. The present example differed from the foregoing Example 3 with respect to a point that the division regarding the activation step was performed on the basis of the device current value If of each line.

Specifically, the electron-emitting devices arranged in (240 rows×480 columns) on the electron source substrate were divided into groups and the blocks were formed as well as the example 3. The line switching was also similarly performed, and the activation step operation was performed.

For the end of the activation step operation of each block, the device current value If flowing through each line was monitored and, when the mean value of the device current flowing through one device reached a predetermined value, the procedure was shifted to the activation operation for the next block.

Specifically, there was applied a method in which in the case where it was assumed that the final arrival value of the mean If of one device was set to 2 mA and the number of activation steps was set to 10, when the mean If value of one device of each step increased as much as 0.2 mA, the procedure was shifted to the activation operation for the next block, the activation step operation was performed to the whole blocks, and after that, the procedure was shifted to the next activation step operation.

In other words, in the activation procedure, the lines X1, X25, X49, . . . , and X217 of the first block were sequentially switched and selected, the voltage pulse for activation was repetitively supplied, and the first activation step operation was performed until the mean If value of one device reached 0.2 mA. Subsequently, the first activation step operation was performed to the second block, third block, . . . , and 24th block in accordance with this order until the mean If value of one device reached 0.2 mA. Consequently, the first activation step operation of the whole blocks was completed.

Similarly, the activation operation from the second to tenth activation steps was performed until the mean If value of one device of each block increased as much as 0.2 mA in each step, so that the activation operation was performed to the whole blocks. The activation operation was completed.

When the device current value If of each line at the end of the tenth activation step operation was checked, every line indicated substantially the same value.

As a result of the activation as mentioned above, the emission current properties of the electron-emitting devices were remarkably uniform, so that an image-forming apparatus (display apparatus) manufactured by using the electron source having a plurality of such electron-emitting devices produced high-quality images.

EXAMPLE 5

A fifth example according to the present invention will now be described in detail hereinbelow.

In the present example, entirely the same activation apparatus and electron source substrate as those of the foregoing Example 3 were used and similarly connected. There was used the activation voltage source to generate an output in which the pulse width was set to 1 msec, pulse interval was set to 1.1 msec, and the voltage peak value was set to 14 V. The present example differed from the foregoing Example 3 with respect to a point that the division for the activation step was performed on the basis of the partial pressure of the activation gas in an image-forming apparatus.

Specifically, the electron-emitting devices arranged in (240 rows×480 columns) on the electron source substrate were divided into groups and the blocks were formed as well as the Example 3, the line switching was also similarly performed and the activation step operation was performed.

For the end of the activation step operation of each block, the activation gas partial pressure in the image-forming apparatus was monitored and, when the activation gas partial pressure reached a predetermined value, the procedure was shifted to the activation operation for the next bock.

Specifically, benzonitrile as an activation gas was introduced into the image-forming apparatus so as to be $2\times10^{-6}$ Torr. When the partial pressure of benzonitrile was fluctuated as much as 5%, the procedure was shifted to the next activation step operation. In other words, since there were 24 blocks in the present example, when the partial pressure was fluctuated during the activation operation for one block as much as a value obtained by equally dividing 5% for one activation operation step into 24 parts, the activation operation was shifted to the next block. At a time point when the first activation step operation for the whole blocks was finished, the procedure was shifted to the next activation operation step.

Finally, when the final arrival value of the mean If of one device was equal to 2 mA, the final activation step operation for each block was finished and the activation procedure was terminated.

When the device current value If of each line at the end of the final activation step operation was checked, every line indicated substantially the same value.

As a result of the activation as mentioned above, the emission current properties of the electron-emitting devices were remarkably uniformed, so that the image-forming apparatus (display apparatus) manufactured by using the electron source having a plurality of electron-emitting devices produced high-quality images.

EXAMPLE 6

The present example shows an example of the method of manufacturing an electron source substrate in which a large number of surface conduction electron-emitting devices are arranged in a simple matrix form (the number of devices= 480×720) and mainly shows an example of the activation operating process of the electron source substrate.

The present example will now be specifically described with reference to FIGS. 23, 1A, 1B, and 2.

Referring to FIG. 2, the activation voltage source 11 generates an activation voltage pulse. The line selection region 12 applies the voltage pulse generated by the activation voltage source to a necessary line. The ammeter 13 monitors a total current value of the device current flowing through the electron-emitting devices arranged in each line. The control region 14 controls the activation voltage source 11 and the line selection region 12 on the basis of the device current value of one line detected by the ammeter 13. A plurality of electron-emitting devices to be activated, to which the forming operation has already been performed, are arranged in a simple matrix form of (m rows×n columns) (in the present example, since m=480 and n=720, 480 rows×720 columns) on the electron source substrate 10.

In this instance, the electron source substrate 10 was disposed in a vacuum apparatus (not shown) in an atmosphere of benzonitrile as an activation gas. The X-directional wirings Dx1 to Dxm of the electron source substrate were connected to Sx1 to Sxm of the activation operation apparatus. In the present example, there as used the activation voltage source to generate an output in which the pulse width was set to 1 msec, pulse interval was set to 1.1 msec, and voltage peak value was set to 14 V.

In this case, one row was set to one group and 10 rows, namely, 10 groups constituted one block and the whole of 480 rows were divided into 48 blocks. Specifically, the first to 10th lines of the X-directional wirings constituted a first block, subsequent 10 lines constituted a second block, the following lines similarly constituted blocks, and the 471st to 480th lines were set to a 48th block.

In the activation, the first activation step operation was sequentially performed one block by one. The activation operating method in the first block, namely, in the lines Dx1 to Dx10 will now be described hereinbelow. In this case, it was assumed that each activation step operation was finished for a predetermined period of time. The period was determined to five minutes and the number of activation step operations was set to 12 steps, so that the activation operation was performed to the lines for 60 minutes in total. In the present example, a voltage for activation having a waveform in which the pulse width=1 msec and the pulse interval=11 msec was applied to each line.

In order to first activate the electron-emitting devices of the lines Dx1 to Dx10, the control region controlled the line selection region, whereby the 10 lines are sequentially switched and selected and the voltage pulse was sequentially applied from the activation voltage source to each line. When the device current If flowing through the electron-emitting devices of the first line was monitored by the ammeter simultaneously with the pulse application, as shown in the first activation step portion in FIG. 23, it was confirmed that the device current If of the first line increased as much as 0.25A after five minutes from the start of the activation. At that time, the first activation step operation for the first block was terminated and the procedure was shifted to the first activation step for the second block.

In a manner similar to the above method, in the first activation step for the second block as well, in order to first activate the electron-emitting devices of lines Dx11 to Dx20, the control region controlled the line selection region, whereby the 10 lines were sequentially switched and selected and the voltage pulse was sequentially applied from the activation voltage source to each line. It was confirmed that the value of the device current If of each line for the second block also increased as well as each line of the first block. After the voltage pulse for activation was applied to the lines of the second block for five minutes, the first activation step operation for the second block was finished and the procedure was shifted to the first activation step for the third block.

The above first activation step operation for five minutes per block was sequentially executed up to the 48th block. In this instance, when attention was paid to the electron-emitting device of the first block, the voltage pulse for activation was not supplied and the devices were left in the activation gas atmosphere for a long time such as (five minutes×47 blocks=) 235 minutes in total, so that the postpause excess current properties easily occurred in the situation.

Subsequently, the first block was selected again and the second activation step operation was subsequently executed. At that time, as shown in FIGS. 1A and 1B, the peak value of the voltage pulse for activation initially supplied was changed to 10 V by controlling the activation voltage source 11 through the control region 14. When the device current If flowing through each line at the time of applying the voltage pulse for the initial second activation step was monitored by the ammeter 13, there was seen such a phenomenon (postpause excess current properties) that the device current largely flowed at the most initial stage of the second activation step operation and, after that, the current amount decreased and stabilized to a predetermined value. Subsequently, when the device current value was stabilized, the waveform conditions, namely, pulse peak value of the pulse voltage applied in the first activation step was returned to 14 V and the second activation step operation was performed continuously for five minutes.

After that, in a manner similar to the first block, the second activation step operation was subsequently performed similarly to the second block to the 48th block. The second activation step operation for all of the blocks was completed.

In a manner similar to the above, the third to twelfth activation step operations were executed to the whole blocks of the first to 48th blocks, so that the activation procedure for the electron-emitting devices on the electron source substrate of the present example was completed.

When the device current If of each line at the end of the twelfth activation step operation was checked, every line indicated substantially the same value. A difference between the If mean value of each line of the first block and that of each line of the 24th block was not over 5%.

As for a period of time needed for the activation for the whole lines, the activation could be performed for substantially the same period of time as that of the method in which the activation was completed every block for the first to 48th blocks and, after that, the procedure was shifted to the activation for the next block. According to the example of the present invention, enough effects could be obtained without extending the activation operation time.

As a result of the activation as mentioned above, the emission current properties of the electron-emitting devices were remarkably uniformed, so that an image-forming apparatus (display apparatus) manufactured by using the electron source having a plurality of such electron-emitting devices produced high-quality images.

COMPARATIVE EXAMPLE 2

Entirely similar to the Example 6, the electron source substrate in which a plurality of forming-operation processed electron-emitting devices were arranged in a simple matrix form of (480 rows×720 columns) was set as shown in FIG. 2. In a manner similar to the Example 6, the electron source substrate was divided into 48 blocks, the activation operation was divided into 12 steps, and the activation operation was sequentially performed.

In the case of the present comparative example, the activation operation was performed in a state where the voltage pulse waveform conditions at the initial stage of each of the second to twelfth activation step operations were set so as to be equivalent to those at the end of the preceding step. At that time, when the value of the device current flowing through the electron-emitting devices of each line was monitored, there was found a line in which the device current value at the initial stage of the next step was lower than that at the end of the activation step of each block. It was considered that it was influenced by the postpause excess current properties. There was generated a line in which the device current value did not reach an enough value even when the activation operation was performed to the twelfth activation step.

As mentioned above, as shown in the Example 6 and Comparative Example 2, the activation was performed by using the activation apparatus of the present invention, so that the properties of the devices could be uniformed.

In the present example, although the electron source substrate having a plurality of electron-emitting devices with a simple matrix arrangement has been described, even in case of the electron source substrate in which a plurality of electron-emitting devices are connected by ladder-like wiring, it is similarly applicable. In this case, one line is set to one group and the activation is executed on a row direction unit basis. The group is formed on a column direction unit basis and the voltage is applied from the column-directional wiring, so that the activation of the present invention can be also executed.

EXAMPLE 7

The second embodiment according to the present invention will now be described in detail hereinbelow.

Although the activation apparatus in the present example is similar to that of the foregoing Example 6, an electron source substrate in which a plurality of electron-emitting devices to which the foregoing forming operation has already been performed are connected in a ladder-like wiring form is used. Such an example will now be described with reference to FIG. 13.

Referring to FIG. 13, 480 electron-emitting devices to be activated, to which the forming operation had already been performed, were arranged in 240 rows in a ladder-like form on an electron source substrate 110 (in FIG. 13, only one part of five rows of 240 rows were shown). The electron source substrate 110 was disposed in a vacuum apparatus (not shown). The half of the ladder-like wirings of the electron source substrate were electrically connected to the line selection region through the ammeter 13 for monitoring the total current value of the device current flowing through the terminals D1 to Dm and the electron-emitting devices arranged in each line. The other half of wirings were connected to the ground level (0 volt). In the present example, it was assumed that the pulse width of an output of the activation voltage source was set to 1 msec, pulse interval was set to 1.1 msec, and the voltage peak value was set to 14 V.

In this case as well, in the same manner as that of the Example 6, one line was set to one group and 10 lines, namely, 10 groups were set to one block. The whole of 240 lines were divided into 24 blocks. Specifically, the first to tenth lines of the X-directional wirings were set to the first block, the next 10 lines were set to the second block, the following lines were similarly set, and the 231st to 240th lines were set to the 24th block.

In the activation, in order to prevent a deterioration of uniformity due to the non-homogeneity of the activation gas, the following two-stage activation step operation was performed in the present example.

The first activation step operation at the first stage was first performed to the first block in an atmosphere obtained by introducing a mixture gas at a total pressure of 10,000 Pa which is made by mixing a nitrogen gas with tolunitrile at a partial pressure of $1\times10^{-2}$ Pa.

In order to activate the electron-emitting devices of the lines Dx1 to Dx10, the control region controlled the line selection region, whereby the 10 lines were sequentially switched and selected every pulse and the voltage pulse was sequentially repetitively supplied from the activation voltage source to each line for one minute. In this case, the voltage for activation having a waveform in which the peak value=14 V, pulse width=1 msec, and pulse interval=11 msec was applied to each line for one minutes.

In this instance, the first activation step operation at the first stage for the first block was terminated and the procedure was shifted to the first activation step operation for the second block.

In the first activation step operation for the second block as well, in a manner similar to the above-mentioned method, so as to activate the electron-emitting devices of the lines Dx11 to Dx20, the control region controlled the line selection region, whereby the 10 lines were sequentially switched and selected and the voltage pulse was sequentially applied from the activation voltage source to each line. After the voltage pulse for activation was applied to each line of the second block for one minutes, the first activation step operation for the second block was terminated and the procedure was shifted to the first activation step for the third block.

The above first activation step operation for one minute per block was sequentially executed up to the 24th block.

Subsequently, the above mixture gas used as an activation gas in the first activation operation was exhausted and a mixture gas at a total pressure of 200 Pa which was made by mixing a nitrogen gas with tolunitrile at a partial pressure of $1\times10^{-4}$ Pa was introduced. In the above gas atmosphere, the second activation step operation at the second stage was performed. When attention was paid to, for example, the electron-emitting devices of the first block, during the first activation step operation for other blocks, for a period of time until the activation gas for the first activation step operation was exhausted, and for a period of time until the activation gas for the second activation step operation was introduced and stabilized, the voltage pulse for activation was not applied to such electron-emitting devices and they were left in the activation gas atmosphere. Accordingly, they were left in a situation where the postpause excess current properties easily occurred.

Subsequently, the first block was selected again and the second activation step operation was executed. At that time, as shown in FIGS. 1A and 1B, the peak value of the voltage pulse for activation initially supplied was changed to 10 V by controlling the activation voltage source 11 through the control region 14. When the device current If flowing through each line at the time of applying the voltage pulse for the initial second activation step was monitored by the ammeter 13, there was seen such a phenomenon (postpause excess current properties) that the device current largely flowed at the most initial stage in the second activation step operation and, after that, the current amount decreased and stabilized to a predetermined value. Subsequently, the waveform conditions, namely, pulse peak value of the pulse voltage applied in the first activation step was returned to 14 V at a time point when the device current value was stabilized. The second activation step operation was performed continuously for 30 minutes.

After that, in a manner entirely similar to the first block, the second activation step operation was subsequently performed to the second to 48th blocks to execute the second activation step operation for all of the blocks. The activation process for the whole blocks was completed.

When the device current If of each line at the end of the second activation step operation was checked, every line indicated substantially the same value. A difference between the If mean value of each line of the first block and that of each line of the 24th block was not over 5%.

As for a period of time needed for the activation of the whole lines, it was possible to perform the activation for substantially the same period of time as that of the method in which the activation was completed every block for the first to tenth blocks and, after that, the procedure was shifted to the activation for the next block. According to the example of the present invention, enough effects could be obtained without extending the activation operation time.

As a result of the activation as mentioned above, the emission current properties of the electron-emitting devices were remarkably uniformed, so that the image-forming apparatus (display apparatus) manufactured by using the electron source having a plurality of such electron-emitting devices produced high-quality images.

COMPARATIVE EXAMPLE 3

Entirely similar to the Example 7, the electron source substrate having a plurality of electron-emitting devices to which the forming-operation had already been performed with a ladder-like arrangement of (240 rows×480 columns) was set. In a manner similar to the Example 7, the electron source substrate was divided into 24 blocks, the activation operation was divided into 2 steps, and the activation operation was sequentially performed. In the case of the present comparative example, the voltage pulse waveform conditions at the start of the second activation step operation were entirely equivalent to those at the end of the preceding step and the activation operation was performed.

At that time, when the value of the device current flowing through the electron-emitting devices of each line was monitored, there was generated a line in which the device current value did not reach an enough value even when the activation operation was performed to the second activation step and this fact seemed to be due to the influence by the postpause excess current properties.

EXAMPLE 8

An eighth example according to the present invention will now be described in detail hereinbelow.

The activation apparatus and electron source substrate to which the forming operation had been performed similar to that of the Example 6 were prepared and the following activation process was performed. In the activation operation, the two-stage activation as described in the example 2 was performed.

In the first activation step operation of the first stage, after benzonitrile at a partial pressure of $1\times10^{-4}$ Pa was introduced as an activation gas, the pulse width of the output of the activation voltage source was set to 1 msec, pulse interval was set to 1.1 msec, and voltage peak value was set to 14 V in a manner similar to the Example 6, and the activation operation was sequentially performed to the first to 24th blocks every 10 minutes. In this case, the voltage for activation having a waveform in which the peak value=14 V, pulse width=1 msec, and pulse interval=1.1 msec was applied to each line for 10 minutes.

Subsequently, the above gas used as an activation gas in the first activation operation was exhausted and tolunitrile at a partial pressure of $1\times10^{-4}$ Pa was mixed to a gas. In the above gas atmosphere, the second activation step operation at the second stage was performed. When attention was paid to, for example, the electron-emitting devices of the first block, during the first activation step operation for other blocks, for a period of time until the activation gas for the first activation step operation was exhausted, and for a period of time until the activation gas for the second activation step operation was introduced and stabilized, the voltage pulse for activation was not applied to such electron-emitting devices and they were left in the activation gas atmosphere, so that they were left in a situation where the postpause excess current properties easily occurred.

The first block was selected again and the second activation step operation was subsequently executed. At that time, as shown in FIGS. 1A and 1B, the peak value of the voltage pulse for activation initially supplied was changed to 10 V by controlling the activation voltage source through the control region. When the device current If flowing through each line at the time of applying the voltage pulse for the initial second activation step was monitored by the ammeter, there was seen such a phenomenon (postpause excess current properties) that the device current largely flowed at the most initial stage of the second activation step operation and, after that, the current amount decreased and stabilized to a predetermined value. Subsequently, the waveform conditions, namely, pulse peak value of the pulse voltage applied in the first activation step was returned to 14 V at a time point when the device current value was stabilized and the second activation step operation was performed continuously for 50 minutes.

After that, in a manner similar to the first block, the second activation step operation was subsequently performed to the second to 48th blocks. The second activation step operation for all of the blocks was executed. The activation process for the whole blocks was completed.

When the device current If of each line at the end of the second activation step operation was checked, every line indicated substantially the same value. A difference between the If mean value of each line in the first block and that of each line in the 24th block was not over 5%.

As a result of the activation as mentioned above, the emission current properties of the electron-emitting devices were remarkably uniformed, so that an image-forming apparatus (display apparatus) manufactured by using the electron source having a plurality of such electron-emitting devices produced high-quality images.

COMPARATIVE EXAMPLE 4

Entirely similar to the Example 7, the electron source substrate on which a plurality of electron-emitting devices to which the forming operation had already been performed were arranged in a ladder-like form of (240 rows×480 columns) was set. In a manner similar to the Example 8, the electron source substrate was divided into 24 blocks, the activation operation was divided into 2 steps, and the activation operation was sequentially performed. In the case of the present comparative example, the voltage pulse waveform conditions at the start of the second activation step operation were entirely equivalent to those at the end of the preceding step and the activation operation was performed.

At that time, when the value of the device current flowing through the electron-emitting devices of each line was monitored, there was generated a line in which the device current value did not reach an enough value even when the activation operation was performed to the second activation step and this fact seemed to be due to the influence by the postpause excess current properties.

EXAMPLE 9

Figure 21:
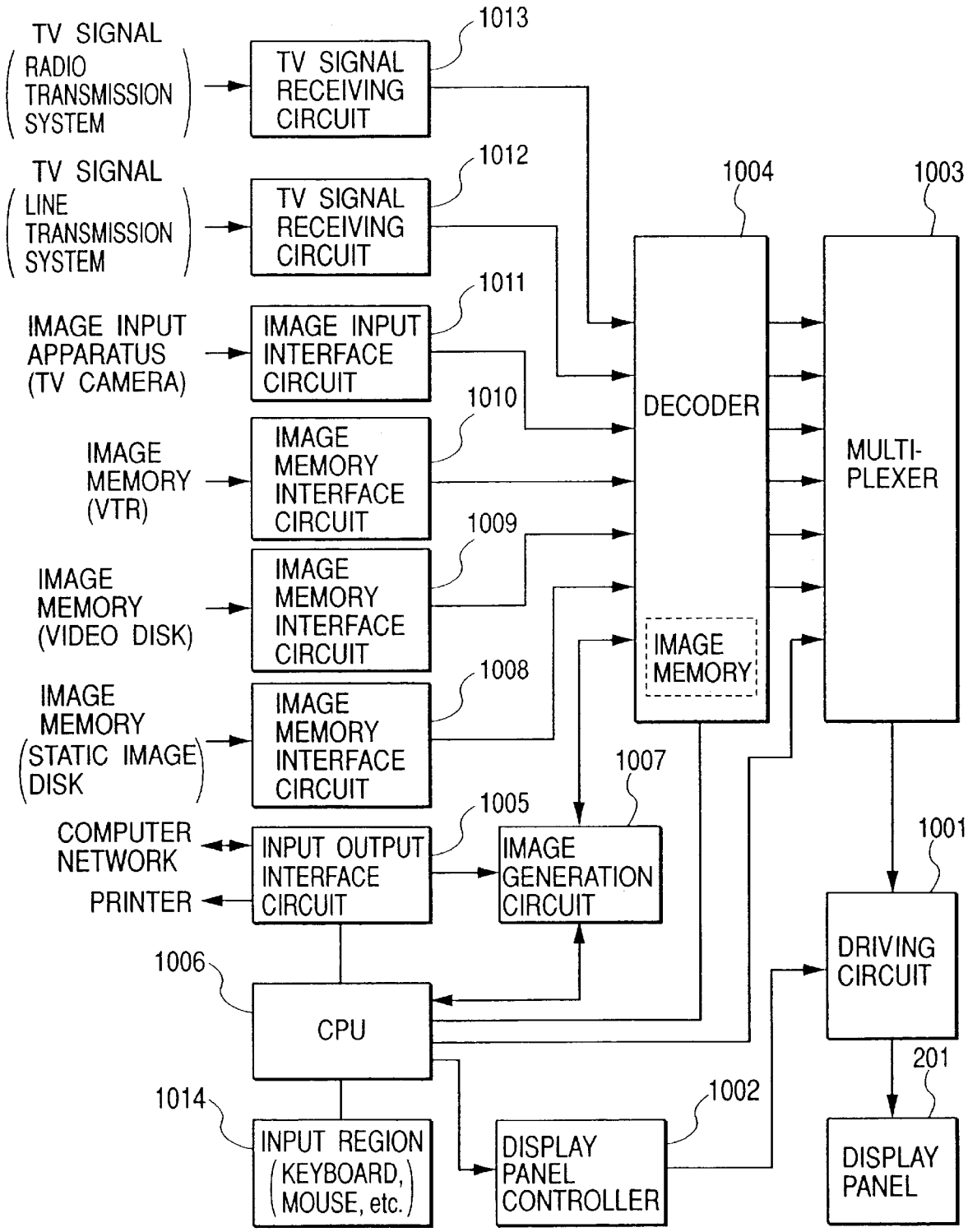
FIG. 21 is a block diagram showing an example of a display apparatus to which the present invention is applied.

FIG. 21 shows an example of a display apparatus (image-forming apparatus) constructed so as to display image information provided from various image information sources such as television broadcasting on a display panel using an electron source having the plurality of electron-emitting devices to which the activation operation has been performed as mentioned above.

Referring to FIG. 21, reference numeral 201 denotes a display panel; 1001 a driving circuit for the display panel; 1002 a display controller; 1003 a multiplexer; 1004 a decoder; 1005 an input output interface circuit; 1006 a CPU; 1007 an image generation circuit; 1008, 1009, and 1010 image memory interface circuits; 1011 an image input interface circuit; 1012 and 1013 TV signal receiving circuit; and 1014 an input region.

When the present display apparatus receives a signal such as a television signal including both of video information and audio information, the apparatus naturally displays video images and simultaneously reproduces audio sounds. Explanation for circuits and loudspeakers regarding reception, separation, reproduction, process, storage, and the like of the audio information which are not directly concerned with the characteristics of the present invention is omitted.

Functions of the respective components will now be described hereinbelow in accordance with the flow of image signals.

First, the TV signal receiving circuit 1013 receives a TV image signal transmitted through a radio transmission system using radio waves or spatial optical communication. A system for the TV signal to be received is not limited to a particular one and any system such as NTSC system, PAL system, or SECAM system can be used. The TV signal system (e.g., the so-called high definition TV such as MUSE system) including scanning lines larger than those of the above systems is a signal source that is preferably used to make the advantage of the display panel suitable for the realization of a large screen and a large number of pixels. The TV signal received by the TV signal receiving circuit 1013 is outputted to the decoder 1004.

The TV signal receiving circuit 1012 receives the TV image signal transmitted via a line transmission system using coaxial cables or optical fibers. Similar to the TV signal receiving circuit 1013, a system for the TV signal to be received is not particularly limited. The TV signal received by the present circuit is also outputted to the decoder 1004.

The image input interface circuit 1011 fetches an image signal supplied from an image input apparatus such as TV camera or image reading scanner. The fetched image signal is generated to the decoder 1004.

The image memory interface circuit 1010 fetches an image signal which has already been stored in a video tape recorder (hereinbelow, abbreviated to VTR). The fetched image signal is outputted to the decoder 1004.

The image memory interface circuit 1009 fetches an image signal stored in a video disc and the fetched image signal is outputted to the decoder 1004.

The image memory interface circuit 1008 fetches an image signal from an apparatus such as a static image disc in which static image data has been stored. The fetched static image data is inputted to the decoder 1004.

The input output interface circuit 1005 connects the present display apparatus to output apparatuses such as external computer, computer network, and printer. In addition to perform the input/output of image data or character/graphic information, the present circuit can input/output a control signal or numeral data between the CPU 1006 provided for the present display apparatus and the outside as necessary.

The image generation circuit 1007 forms image data for display on the basis of the image data or character/graphic information inputted from the outside through the input output interface circuit 1005 or image data or character/graphic information generated from the CPU 1006. In the present circuit, circuits needed for image generation such as reloadable memory for accumulating image data or character/graphic information, read only memory in which image patterns corresponding to character codes have been stored, processor for processing images, and the like have been built.

Display image data generated by the present circuit is outputted to the decoder 1004. If circumstances require, the data can also be outputted to an external computer network or printer through the input output interface circuit 1005.

The CPU 1006 mainly performs the operation control of the present display apparatus or performs operations concerned to the generation, selection, and edition of the display image.

For example, the CPU generates a control signal to the multiplexer 1003 to properly select or combine the image signals to be displayed on the display panel. At that time, the CPU generates a control signal to the display panel controller 1002 in accordance with the image signal to be displayed, to appropriately control the operation of the display apparatus such as image display frequency, scanning method (for example, interlace method or non-interlace method), or the number of scanning lines per screen.

The CPU also directly outputs the image data or character/graphic information to the image generation circuit 1007 or accesses to the external computer or memory through the input output interface circuit 1005 to input the image data or character/graphic information.

The CPU 1006 can also be concerned with the operation for another object. For example, like a personal computer or a word processor, it can be directly concerned with a function for forming or processing information. Alternatively, the CPU is connected to the external computer network through the input output interface circuit 1005 as mentioned above and performs operations such as numerical calculation and the like in cooperation with external equipment.

The input region 1014 is used by the user to input a command, a program, or data to the CPU 1006. As an input region, various input devices such as keyboard, mouse, joystick, barcode reader, and voice recognition device can be used.

The decoder 1004 converts various image signals inputted from the circuits 1007 to 1013 back into signals for three primary colors, or a luminance signal and I and Q signals. As shown in the diagram, preferably, the decoder 1004 includes an image memory therein. The reason is that there are processed television signals such as those of the MUSE system, which require the image memory upon back-conversion.

Providing the image memory facilitates the display of static images as well as such operations as thinning-out, interpolating, enlarging, reducing, synthesizing, and editing frames to be easily performed in cooperation with the image generation circuit 1007 and the CPU 1006.

The multiplexer 1003 appropriately selects images to be displayed on the basis of the control signal inputted from the CPU 1006. That is, the multiplexer 1003 selects desired converted image signals from the back-converted image signals supplied from the decoder 1004 and outputs them to the driving circuit 1001. In this case, it is also possible to divide the display screen into a plurality of frame to display different images simultaneously like a multi-screen television by switching from a set of image signals to a different set of image signals within a period of time for displaying one frame.

The display panel controller 1002 controls the operation of the driving circuit 1001 on the basis of the control signal inputted from the CPU 1006.

The controller also outputs a signal to control an operation sequence of, for example, a power source (not shown) for driving the display panel, serving as a section concerning the fundamental operation of the display panel, to the driving circuit 1001.

The controller also outputs a signal to control the screen display frequency or scanning method (for example, interlace method or non-interlace method) as conditions concerning the driving method of the display panel to the driving circuit 1001.

If circumstances demand, the controller outputs a control signal regarding adjustment of an image quality such as luminance of the display image, contrast, color tone, and sharpness to the driving circuit 1001 in some cases.

The driving circuit 1001 outputs a driving signal to be supplied to the display panel 201 and operates on the basis of the image signal inputted from the multiplexer 1003 and the control signal supplied from the display panel controller 1002.

Although the functions of the respective components have been described, according to the present display apparatus, the image information inputted from various image information sources can be displayed on the display panel 201 with the construction shown in FIG. 21. That is, after various image signals of the television broadcasting and the like are converted back by the decoder 1004, the converted signals are properly selected by the multiplexer 1003 and inputted to the driving circuit 1001. On the other hand, the display controller 1002 generates the control signal to control the operation of the driving circuit 1001 in accordance with the image signal to be displayed. The driving circuit 1001 supplies the driving signal to the display panel 201 on the basis of the image signal and the control signal. Consequently, images are displayed on the display panel 201. Such a series of operations are made under control of the CPU 1006.

The present display apparatus can not only display images selected from images of the image memory included in the decoder 1004 and image generation circuit 1007 and information but also perform image processing such as enlargement, reduction, rotation, movement, edge emphasis, thinning, interpolation, color conversion, image aspect ratio conversion, and image editing such as synthesizing, deletion, combining, replacement, insertion, to image information to be. displayed. Although not especially described in the above examples, similar to the image processing and image editing, circuits for processing and editing audio information may be provided.

Therefore, the present display apparatus can realize functions of various devices such as TV broadcasting display device, teleconference terminal device, image editing device for static images and movement images, office-work terminal device such as computer terminal device or word processor, game machine, and the like. Accordingly, the present display apparatus has an extremely wide application range for industrial use and private use.

FIG. 21 merely shows one example of the construction of the display apparatus using the display panel having an electron beam source comprising the surface conduction electron-emitting devices, but it is not limited to it. For example, in FIG. 21, circuits unnecessary for some use may be omitted. Contrarily, constitutional components may be added for some purpose. For example, if the present display apparatus is used as a television telephone, a television camera, a microphone, an illumination device, a transceiver including a modem may be preferably added.

In the present display apparatus, since the display panel having the electron beam source comprising the electron-emitting devices can be easily thinned, the depth of the display apparatus can be reduced. In addition, since the display panel having the electron-emitting devices as an electron beam source can be easily enlarged and it has high luminance and an increased view angle, the present display apparatus can display vivid images with realism and impressiveness.

According to the present invention as mentioned above, in the electron source comprising a plurality of electron-emitting devices, the activation operation for each electron-emitting device is uniformly performed, a variation in the electron-emitting properties of the electron-emitting devices can be suppressed, and when the electron source is applied to the image-forming apparatus, variation in luminance can be suppressed.

According to the present invention, in the electron source comprising the electron-emitting devices to which the activation operation comprising a plurality of steps is performed, the activation defect in each electron-emitting device can be prevented, a variation in electron-emitting properties of the electron-emitting devices can be suppressed, and when the electron source is applied to the image-forming apparatus, a variation in luminance can be suppressed.

What is claimed is:

1. A method for manufacturing an electron source, including an activation operation for repetitively applying a pulse voltage to a plurality of electron-emitting devices in an atmosphere containing an organic material to form a film containing carbon from the organic material existing in the atmosphere, wherein said activation operation for the plurality of electron-emitting devices is performed in such a manner that said activation operation is divided into a plurality of steps from a first activation step to a final activation step, the plurality of electron-emitting devices are divided into operation units each comprising a plurality of device groups, each of which includes a plurality of electron-emitting devices, the first activation step of the activation operation is sequentially executed from an arbitrary operation unit wherein, in the first activation step, a pulse voltage is applied to each of the plurality of device groups sequentially, and the sequential applying of the voltage is repeated a plurality of times, the first activation step for all of the operation units is terminated, after that, the plurality of electron-emitting devices are divided into operation units each comprising a plurality of device groups, each of which includes a plurality of electron-emitting devices, a next activation step for all of the operation units is terminated in a manner similar to said first activation step, and such a procedure is repeated until the final activation step.

2. The method for manufacturing an electron source according to claim 1, wherein on the basis of an application time of the pulse voltage necessary for the activation operation, said activation operation is divided into a plurality of steps in which said application time is divided.

3. The method for manufacturing an electron source according to claim 1, wherein said activation operation is divided into a plurality of steps on the basis of a change in value of a current which flows through the electron-emitting devices and which varies depending on the progress of the activation operation.

4. The method for manufacturing an electron source according to claim 1, wherein said activation operation is divided into a plurality of steps on the basis of the partial pressure of an activation gas in the atmosphere containing the organic material, in which the activation operation is performed.

5. The method for manufacturing an electron source according to claim 1, wherein said activation operation is performed in such a state where a plurality of electron-emitting devices are arranged in a container and an activation gas containing the organic material is introduced into the container, and the introduction pressure of the activation gas to the container is equal to or less than $1\times10^{-4}$ Torr.

6. The method for manufacturing an electron source according to claim 1, wherein each device group includes a plurality of electron-emitting devices connected by a common wiring and said pulse voltage is applied to each group from one end or both ends of said common wiring.

7. The method according to claim 1, wherein said plurality of electron-emitting devices are connected in a matrix form by a plurality of row-directional wirings and a plurality of column-direction wirings and said pulse voltage is sequentially applied to said plurality of electron-emitting devices every row-directional wiring or column-directional wiring.

8. The method for manufacturing an electron source according to claim 1, wherein the pulse voltage waveform condition for the activation processing at a beginning of the next activation step is set different from the pulse voltage waveform condition for the activation processing at the ending of a previous activation step.

9. A method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation is divided into a plurality of steps and then performed on a selected one of the electron-emitting devices, the activation operation divided into the plurality of steps having a pause time during which the activation operation is not executed between the activation operation steps for the selected electron emitting device, waveform conditions of a pulse voltage at an initial stage of the activation operation in a next step to be performed after the pause time are made different from those of a pulse voltage at a final stage of the activation operation in a preceding step, wherein the waveform conditions of the pulse voltage, being made different at the initial stage of the activation operation in the next step, denote a pulse peak value; and wherein the pulse peak value of the pulse voltage, being made different at the initial stage of the activation operation in the next step, is set so as to be smaller than that of the pulse voltage at the final stage of the activation operation in the preceding step.

10. A method for manufacturing an electron source, including an activation operation for repetitively applying a pulse voltage to each of a plurality of electron-emitting devices in an atmosphere containing an organic material to form a film containing carbon from the organic material existing in the atmosphere, wherein the activation operation is divided into a plurality of steps and then performed on a selected one of the electron-emitting devices, the activation operation divided into the plurality of steps having a pause time during which the activation operation is not executed between the activation operation steps for the selected electron emitting device, waveform conditions of a pulse voltage at an initial stage of the activation operation in a next step to be performed after the pause time are made different from those of a pulse voltage at a final stage of the activation operation in a preceding step, wherein the waveform conditions of the pulse voltage, being made different at the initial stage of the activation operation in the next step, denote a pulse peak value; and wherein the pulse peak value of the pulse voltage, being made different at the initial stage of the activation operation in the next step, is set so as to be smaller than that of the pulse voltage at the final stage of the activation operation in the preceding step and so as to be equal to or larger than ½ of the peak value.

11. A method for manufacturing an electron source, including an activation operation for repetitively applying a pulse voltage to each of a plurality of electron-emitting devices in an atmosphere containing an organic material to form a film containing carbon from the organic material existing in said atmosphere, wherein the activation operation is divided into a plurality of steps and then performed on a selected one of the electron-emitting devices, the activation operation divided into the plurality of steps having a pause time during which the activation operation is not executed between the activation operation steps for the selected electron emitting device, waveform conditions of a pulse voltage at an initial stage of the activation operation in a next step to be performed after the pause time are made different from those of a pulse voltage at a final stage of the activation operation in a preceding step, wherein the waveform conditions of the pulse voltage, being made different at the initial stage of the activation operation in the next step, denote a pulse width; and wherein the pulse width of the pulse voltage, being made different at the initial stage of the activation operation in the next step, is set so as to be smaller than that of the pulse voltage at the final stage of the activation operation in the preceding step.

* * * * *

UNITED STATES PATENT AND TRADEMARK OFFICE

CERTIFICATE OF CORRECTION

PATENT NO. : 6,612,887 B1
DATED : September 2, 2003
INVENTOR(S) : Hisaaki Kawade It is certified that error appears in the above-identified patent and that said Letters Patent is hereby corrected as shown below:

Column 13,
Line 64, “maintain” should read -- maintained --.

Column 18,
Line 25, “tuned” should read -- turned --.

Column 32,
Line 3, “was set” should be deleted.
Line 67, “The-activation” should read -- The activation --.

Column 43,
Line 39, “system can be used.” should read -- system. --.

Column 45,
Line 62, “be.” should read -- be --.

Signed and Sealed this

Thirtieth Day of March, 2004

JON W. DUDAS
*Acting Director of the United States Patent and Trademark Office*